US011328685B2

(12) United States Patent
Yang et al.

(10) Patent No.: US 11,328,685 B2
(45) Date of Patent: May 10, 2022

(54) COMMON VOLTAGE CALIBRATION CIRCUIT AND DRIVING METHOD THEREOF, CIRCUIT BOARD AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Kun Yang, Beijing (CN); Wenwu Lu, Beijing (CN); Chunyang Nie, Beijing (CN); Ke Dai, Beijing (CN)

(73) Assignees: Hefei Xinsheng Optoelectronics Technology Co., Ltd., Hefei (CN); BOE Technology Group Co., Ltd., Beijing (CN)

( * ) Notice: Subject to any disclaimer, the term of this patent is extended or adjusted under 35 U.S.C. 154(b) by 533 days.

(21) Appl. No.: 16/335,054

(22) PCT Filed: Jul. 17, 2018

(86) PCT No.: PCT/CN2018/095988
§ 371 (c)(1),
(2) Date: Mar. 20, 2019

(87) PCT Pub. No.: WO2019/056841
PCT Pub. Date: Mar. 28, 2019

(65) Prior Publication Data

US 2021/0335316 A1 Oct. 28, 2021

(30) Foreign Application Priority Data

Sep. 20, 2017 (CN) ..... 201710858445.7

(51) Int. Cl.
*G09G 3/36* (2006.01)

(52) U.S. Cl.
CPC ... *G09G 3/3696* (2013.01); *G09G 2310/0243* (2013.01); *G09G 2320/0209* (2013.01);
(Continued)

(58) Field of Classification Search
CPC ..... G09G 3/36; G09G 3/3611; G09G 3/3614; G09G 3/3655; G09G 3/3677;
(Continued)

(56) References Cited

U.S. PATENT DOCUMENTS 10,504,472 B2 * 12/2019 Dai ..... G09G 3/3688
10,529,297 B2 * 1/2020 Liu ..... G09G 3/3696
(Continued)

FOREIGN PATENT DOCUMENTS

CN 102842295 A 12/2012
CN 104680997 A 6/2015
(Continued)

OTHER PUBLICATIONS

Oct. 17, 2018—(WO) International Search Report and Written Opinion Appn PCT/CN2018/095988 with English Translation.

*Primary Examiner* — Alexander Eisen
*Assistant Examiner* — Nelson Lam
(74) *Attorney, Agent, or Firm* — Banner & Witcott, Ltd.

(57) ABSTRACT

A common voltage calibration circuit and a driving method thereof, a circuit board and a display device are provided. The common voltage calibration circuit includes a difference circuit, a compensation circuit and a summing circuit; the difference circuit is configured to perform a difference processing on a common voltage provided by the common voltage input terminal and a feedback common voltage provided by the common voltage feedback terminal to output a difference value signal; the compensation circuit is configured to receive the difference value signal and compensate the common voltage based on the difference value
(Continued)

signal; and the summing circuit is configured to superimpose at least two compensation signals output by the compensation circuit and output through the common voltage output terminal.

15 Claims, 9 Drawing Sheets

(52) U.S. Cl.
CPC ..... *G09G 2320/0252* (2013.01); *G09G 2320/0257* (2013.01); *G09G 2320/0693* (2013.01)

(58) Field of Classification Search
CPC ..... G09G 3/3681; G09G 3/3696; G09G 2310/0243; G09G 2320/0693
USPC ..... 345/87–104
See application file for complete search history.

(56) References Cited

U.S. PATENT DOCUMENTS 10,916,209 B2 * 2/2021 Wang ..... G09G 3/3655
2006/0145995 A1 * 7/2006 Kim ..... G09G 3/3655 345/98
2006/0244704 A1 * 11/2006 JaeHun ..... G09G 3/3655 345/92
2007/0024560 A1 * 2/2007 Kim ..... G09G 3/3655 345/94
2007/0024565 A1 2/2007 Choi
2009/0102780 A1 * 4/2009 Brown ..... G09G 3/3648 345/101
2011/0102401 A1 * 5/2011 Feng ..... G09G 3/3655 345/211
2012/0218249 A1 * 8/2012 Koo ..... H03F 3/2173 345/212
2014/0028535 A1 * 1/2014 Min ..... G09G 3/3655 345/87
2014/0062990 A1 * 3/2014 Zhang ..... G09G 3/3655 345/212
2015/0103067 A1 * 4/2015 Woo ..... G09G 3/3696 345/213
2016/0117988 A1 * 4/2016 Lee ..... G09G 3/3233 345/205
2016/0149574 A1 * 5/2016 Cui ..... G09G 3/3696 327/513
2020/0066221 A9 * 2/2020 Wang ..... G09G 3/3696
2021/0118346 A1 * 4/2021 Zhang ..... G09G 3/3655
2021/0118383 A1 * 4/2021 Zhang ..... G09G 3/3696

FOREIGN PATENT DOCUMENTS

CN 105513527 A 4/2016
CN 105654888 A 6/2016
CN 107578752 A 1/2018

* cited by examiner

COMMON VOLTAGE CALIBRATION CIRCUIT AND DRIVING METHOD THEREOF, CIRCUIT BOARD AND DISPLAY DEVICE

The application is a U.S. National Phase Entry of International Application No. PCT/CN2018/095988 filed on Jul. 17, 2018, designating the United States of America and claiming priority to Chinese Patent Application No. 201710858445.7, filed on Sep. 20, 2017. The present application claims priority to and the benefit of the above-identified applications and the above-identified applications are incorporated by reference herein in their entirety.

TECHNICAL FIELD

Embodiments of the present disclosure relate to a common voltage calibration circuit and a driving method thereof, a circuit board and a display device.

BACKGROUND

Liquid crystal display devices have become leading products due to advantages of low power consumption, no radiation, high resolution and the like. In the display driving process of a liquid crystal display device, a common voltage ($V_{COM}$) is used as a reference voltage for charging each of a plurality of pixels, and the stability of the common voltage is related to an actual charging voltage of each of the plurality of pixels, thereby affecting the display effect of the liquid crystal display device. During an actual driving process of a display panel, due to the interference by coupling between a load and a signal, the $V_{COM}$ is pulled, which causes a distortion of the actual charging voltage of each of the pixels and an asymmetry between a positive voltage and a negative voltage, and causes display defects such as cross-talk and afterimage and the like.

SUMMARY

At least one embodiment of the present disclosure provides a common voltage calibration circuit, the common voltage calibration circuit includes a difference circuit, a compensation circuit and a summing circuit. The difference circuit is connected to a common voltage input terminal and a common voltage feedback terminal, and configured to perform a difference processing on a common voltage provided by the common voltage input terminal and a feedback common voltage provided by the common voltage feedback terminal to output a difference value signal; the compensation circuit is connected to the difference circuit and the summing circuit, and configured to receive the difference value signal and compensate the common voltage based on the difference value signal; and the summing circuit is connected to the compensation circuit and a common voltage output terminal, and configured to superimpose at least two compensation signals output by the compensation circuit and output through the common voltage output terminal.

For example, in a common voltage calibration circuit provided by at least one embodiment of the present disclosure, the compensation circuit comprises at least two of a proportional compensation sub-circuit, an integral compensation sub-circuit, and a differential compensation sub-circuit. The proportional compensation sub-circuit is connected to the difference circuit and the summing circuit, and configured to inversely amplify the difference value signal output by the difference circuit; the integral compensation sub-circuit is connected to the difference circuit and the summing circuit, and configured to perform an integration processing on the difference value signal output by the difference circuit to control accuracy of the common voltage; and the differential compensation sub-circuit is connected to the difference circuit and the summing circuit, and configured to generate an adjustment signal according to the difference value signal output by the difference circuit to adjust the common voltage.

For example, in a common voltage calibration circuit provided by at least one embodiment of the present disclosure, the difference circuit comprises a first amplifier, a first resistor, a second resistor, a third resistor and a fourth resistor; wherein one terminal of the first resistor is connected to the common voltage feedback terminal, another terminal of the first resistor is connected to an inverting input terminal of the first amplifier; one terminal of the second resistor is connected to the common voltage input terminal, another terminal of the second resistor is connected to a non-inverting input terminal of the first amplifier; one terminal of the third resistor is connected to the non-inverting input terminal of the first amplifier, another terminal of the third resistor is grounded; and one terminal of the fourth resistor is connected to the inverting input terminal of the first amplifier, another terminal of the fourth resistor is connected to an output terminal of the first amplifier.

For example, in a common voltage calibration circuit provided by at least one embodiment of the present disclosure, the integral compensation sub-circuit comprises a second amplifier, a fifth resistor, a sixth resistor and a first capacitor. One terminal of the fifth resistor is connected to an output terminal of the difference circuit, another terminal of the fifth resistor is connected to an inverting input terminal of the second amplifier; one terminal of the sixth resistor is connected to a non-inverting input terminal of the second amplifier, another terminal of the sixth resistor is grounded; and one terminal of the first capacitor is connected to the inverting input terminal of the second amplifier, another terminal of the first capacitor is connected to an output terminal of the second amplifier.

For example, in a common voltage calibration circuit provided by at least one embodiment of the present disclosure, the fifth resistor is an adjustable resistor.

For example, in a common voltage calibration circuit provided by at least one embodiment of the present disclosure, the proportional compensation sub-circuit comprises a third amplifier, a seventh resistor, an eighth resistor and a ninth resistor. One terminal of the seventh resistor is connected to an output terminal of the difference circuit, another terminal of the seventh resistor is connected to an inverting input terminal of the third amplifier; one terminal of the eighth resistor is connected to a non-inverting input terminal of the third amplifier, another terminal of the eighth resistor is grounded; and one terminal of the ninth resistor is connected to the inverting input terminal of the third amplifier, another terminal of the ninth resistor is connected to an output terminal of the third amplifier.

For example, in a common voltage calibration circuit provided by at least one embodiment of the present disclosure, the seventh resistor is an adjustable resistor.

For example, in a common voltage calibration circuit provided by at least one embodiment of the present disclosure, the differential compensation sub-circuit comprises a fourth amplifier, a tenth resistor, an eleventh resistor, a twelfth resistor and a second capacitor. One terminal of the second capacitor is connected to an output terminal of the difference circuit, another terminal of the second capacitor is connected to a terminal of the tenth resistor; another terminal of the tenth resistor is connected to an inverting input terminal of the fourth amplifier; one terminal of the eleventh resistor is connected to a non-inverting input terminal of the fourth amplifier, another terminal of the eleventh resistor is grounded; and one terminal of the twelfth resistor is connected to the inverting input terminal of the fourth amplifier, another terminal of the twelfth resistor is connected to an output terminal of the fourth amplifier.

For example, in a common voltage calibration circuit provided by at least one embodiment of the present disclosure, the tenth resistor is an adjustable resistor.

For example, in a common voltage calibration circuit provided by at least one embodiment of the present disclosure, in a case where the compensation circuit comprises the proportional compensation sub-circuit and the differential compensation sub-circuit, the summing circuit comprises a fifth amplifier, a thirteenth resistor, a fourteenth resistor, a sixteenth resistor and a seventeenth resistor. One terminal of the thirteenth resistor is connected to an output terminal of the proportional compensation sub-circuit, another terminal of the thirteenth resistor is connected to an inverting input terminal of the fifth amplifier; one terminal of the fourteenth resistor is connected to an output terminal of the differential compensation sub-circuit, another terminal of the fourteenth resistor is connected to the inverting input terminal of the fifth amplifier; one terminal of the sixteenth resistor is connected to a non-inverting input terminal of the fifth amplifier, another terminal of the sixteenth resistor is grounded; one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

For example, in a common voltage calibration circuit provided by at least one embodiment of the present disclosure, in a case where the compensation circuit comprises the proportional compensation sub-circuit and the integral compensation sub-circuit, the summing circuit comprises a fifth amplifier, a thirteenth resistor, a fourteenth resistor, a sixteenth resistor and a seventeenth resistor. One terminal of the thirteenth resistor is connected to an output terminal of the proportional compensation sub-circuit, another terminal of the thirteenth resistor is connected to an inverting input terminal of the fifth amplifier; one terminal of the fourteenth resistor is connected to an output terminal of the integral compensation sub-circuit, another terminal of the fourteenth resistor is connected to the inverting input terminal of the fifth amplifier; one terminal of the sixteenth resistor is connected to a non-inverting input terminal of the fifth amplifier, another terminal of the sixteenth resistor is grounded; one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

For example, in a common voltage calibration circuit provided by at least one embodiment of the present disclosure, in a case where the compensation circuit comprises the integral compensation sub-circuit and the differential compensation sub-circuit, the summing circuit comprises a fifth amplifier, a thirteenth resistor, a fourteenth resistor, a sixteenth resistor and a seventeenth resistor. One terminal of the thirteenth resistor is connected to an output terminal of the integral compensation sub-circuit, another terminal of the thirteenth resistor is connected to an inverting input terminal of the fifth amplifier; one terminal of the fourteenth resistor is connected to an output terminal of the differential compensation sub-circuit, another terminal of the fourteenth resistor is connected to the inverting input terminal of the fifth amplifier; one terminal of the sixteenth resistor is connected to a non-inverting input terminal of the fifth amplifier, another terminal of the sixteenth resistor is grounded; one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

For example, in a common voltage calibration circuit provided by at least one embodiment of the present disclosure, in a case where the compensation circuit comprises the proportional compensation sub-circuit, the integral compensation sub-circuit and the differential compensation sub-circuit, the summing circuit comprises a fifth amplifier, a thirteenth resistor, a fourteenth resistor, a fifteenth resistor, a sixteenth resistor and a seventeenth resistor. One terminal of the thirteenth resistor is connected to an output terminal of the integral compensation sub-circuit, another terminal of the thirteenth resistor is connected to an inverting input terminal of the fifth amplifier; one terminal of the fourteenth resistor is connected to an output terminal of the proportional compensation sub-circuit, another terminal of the fourteenth resistor is connected to the inverting input terminal of the fifth amplifier; one terminal of the fifteenth resistor is connected to an output terminal of the differential compensation sub-circuit, another terminal of the fifteenth resistor is connected to the inverting input terminal of the fifth amplifier; one terminal of the sixteenth resistor is connected to a non-inverting input terminal of the fifth amplifier, another terminal of the sixteenth resistor is grounded; one terminal of the seventeenth resistor is connected to the inverting input terminal of the fifth amplifier, another terminal of the seventeenth resistor is connected to an output terminal of the fifth amplifier; and the output terminal of the fifth amplifier is connected to the common voltage output terminal.

At least one embodiment of the present disclosure provides a circuit board, comprising the common voltage calibration circuit according to any one of embodiments of the present disclosure.

At least one embodiment of the present disclosure provides a display device, comprising a display panel and the common voltage calibration circuit according to any one of embodiments of the present disclosure. The display panel comprises a common electrode electrically connected to the common voltage output terminal of the common voltage calibration circuit.

At least one embodiment of the present disclosure provides a driving method of the common voltage calibration circuit according to claim 1, comprising: performing, by the difference circuit, a difference processing on the common voltage and the feedback common voltage and outputting the difference value signal; performing, by the compensation circuit, inverse amplification, integration, and/or differential adjustment on the difference value signal to compensate the common voltage; and superimposing, by the summing circuit, at least two compensation signals output by the compensation circuit to obtain a common voltage which is compensated, outputting the common voltage through the common voltage output terminal.

BRIEF DESCRIPTION OF THE DRAWINGS

In order to demonstrate clearly technical solutions of the embodiments of the present disclosure, the accompanying drawings in relevant embodiments of the present disclosure will be introduced briefly. It is apparent that the drawings may only relate to some embodiments of the disclosure and not intended to limit the present disclosure.

DETAILED DESCRIPTION

Figure 1:
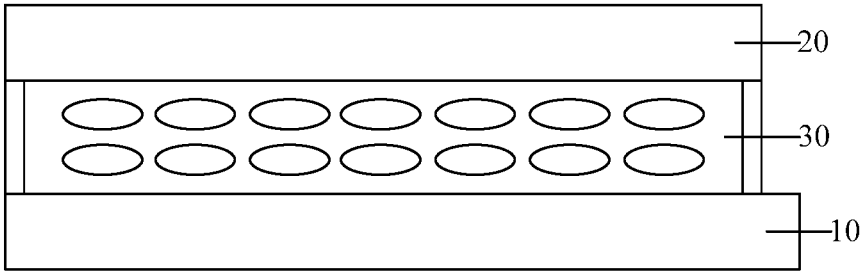
FIG. 1 is a schematic diagram of a display panel according to an embodiment of the present disclosure.

In order to make objects, technical details and advantages of the embodiments of the disclosure apparent, the technical solutions of the embodiment will be described in a clearly and fully understandable way in connection with the drawings related to the embodiments of the disclosure. It is apparent that the described embodiments are just a part but not all of the embodiments of the disclosure. Based on the described embodiments herein, those skilled in the art may obtain other embodiment, without any creative work, which shall be within the scope of the disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present disclosure, are not intended to indicate any sequence, amount or importance, but for distinguishing various components. The terms, such as "comprise/comprising," "include/including," or the like are intended to specify that the elements or the objects stated before these terms encompass the elements or the objects and equivalents thereof listed after these terms, but not preclude other elements or objects. The terms, such as "connect/connecting/connected," "couple/coupling/coupled" or the like, are not limited to a physical connection or mechanical connection, but may include an electrical connection/coupling, directly or indirectly. The terms, "on," "under," "left," "right," or the like are only used to indicate relative position relationship, and when the position of the object which is described is changed, the relative position relationship may be changed accordingly.

In order to improve display characteristics of a display panel, achieve a rapid response to a system and quickly eliminate a pull action of external interference on a $V_{COM}$, in a driving process of the display panel, a difference value between an expected value of the $V_{COM}$ and a feedback value of the $V_{COM}$ is inversely amplified usually by an adjustable proportional operational amplifier circuit, so as to achieve suppression and compensation to the pull action on the $V_{COM}$, thereby realizing a real-time adjustment and calibration of the $V_{COM}$. Although the adjustable proportional operational amplifier circuit can achieve a rapid response to the system and quickly eliminate the pull action of external interference on the $V_{COM}$, the adjustable proportional operational amplifier circuit cannot eliminate the steady-state error of the $V_{COM}$, and a simple proportional amplification circuit is easily to cause phenomenon such as serious system overshoot, easily making the voltage value $V_{COM}$ to be oscillated, and the like.

At least one embodiment of the present disclosure provides a common voltage calibration circuit, the common voltage calibration circuit includes a difference circuit, a compensation circuit and a summing circuit. The difference circuit is connected to a common voltage input terminal and a common voltage feedback terminal, and configured to perform a difference processing on a common voltage provided by the common voltage input terminal and a feedback common voltage provided by the common voltage feedback terminal so as to output a difference value signal; the compensation circuit is connected to the difference circuit and the summing circuit, and configured to receive the difference value signal and compensate the common voltage based on the difference value signal; and the summing circuit is connected to the compensation circuit and a common voltage output terminal, and configured to superimpose at least two compensation signals output by the compensation circuit and output through the common voltage output terminal.

At least one embodiment of the present disclosure provides a circuit board, a display device and a driving method corresponding to the common voltage calibration circuit above-described.

The common voltage calibration circuit and the driving method thereof, the circuit board and the display device provided by the above embodiments of the present disclosure obtain a voltage difference value between the common voltage input terminal and the common voltage feedback terminal through the difference circuit, and achieve a rapid response to the $V_{COM}$ by the proportional compensation sub-circuit in the compensation circuit, or achieve continuous accumulation of the voltage difference value output by the differential circuit through an integral compensation sub-circuit in the compensation circuit, thereby effectively achieving an accuracy control on the common voltage, reducing a steady-state error between the common voltage actually input to a common electrode during a common voltage calibration process and a desired voltage, or optimizing an adjustment compensation of the $V_{COM}$ through a differential compensation sub-circuit, thus effectively suppressing overshoot; on the basis of above, the output values of at least two of the compensation sub-circuits in the compensation circuit are superimposed and output through the summing circuit, thereby realizing the compensation of the common voltage, and further improving the stability of the common voltage actually input to the common electrode. In summary, the common voltage calibration circuit provided by the embodiments of the present disclosure satisfies a requirement on the control accuracy and stability of the common voltage input to the common electrode, thereby effectively alleviating cross-talk and afterimage of the display panel during display, and improving display quality of the display panel.

Hereinafter, each of embodiments according to the present disclosure will be described in detail with reference to the drawings. It is to be noted that in the drawings, the same reference numerals are given to the components having substantially the same or similar structures and functions, and the repeated description thereof will be omitted.

An embodiment of the present disclosure provides a common voltage calibration circuit which is used, for example, to drive an organic light-emitting diode (OLED) display device, a liquid crystal display device or the like. The embodiments of the present disclosure are described by taking a liquid crystal display device as an example, the following embodiments are the same as the above, and are not described again.

FIG. 1 is a schematic diagram of a display panel according to an embodiment of the present disclosure. For example, a liquid crystal display device includes a display panel, as shown in FIG. 1, the display panel includes an array substrate 10, a counter substrate 20, and a liquid crystal layer 30 between the array substrate 10 and the counter substrate 20.

Figure 2:
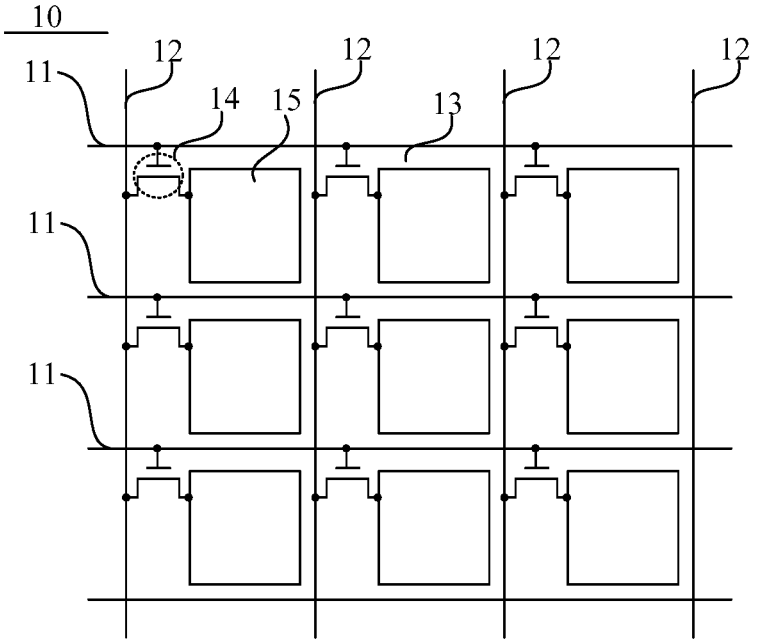
FIG. 2 is a schematic diagram of an array substrate according to an embodiment of the present disclosure.

FIG. 2 is a schematic diagram of an array substrate according to an embodiment of the present disclosure. As shown in FIG. 2, an array substrate 10 includes gate lines 11 and data lines 12, the gate lines 11 and the data lines 12 intersect to define pixel units 13, and each of pixel units 13 includes a thin film transistor 14, a pixel electrode 15 and a common electrode (not identified in FIG. 2); a gate electrode of the thin film transistor 14 is electrically connected to one of the gate lines 11, a source electrode of the thin film transistor 14 is electrically connected to one of the data lines 12, and the drain electrode of the thin film transistor 14 is electrically connected to the pixel electrode 15. The common electrodes may be electrically connected into form a single body; or the common electrodes may also be divided into regions, the common electrodes in one region are electrically connected together, and the common electrodes in different regions are insulated from each other.

It should be noted that the common electrodes may be disposed on the array substrate 10 or the counter substrate 20. The embodiments of the present disclosure are described by taking the common electrodes disposed on the array substrate 10, and the following embodiments are the same as the above, which is not described again.

Figure 3:
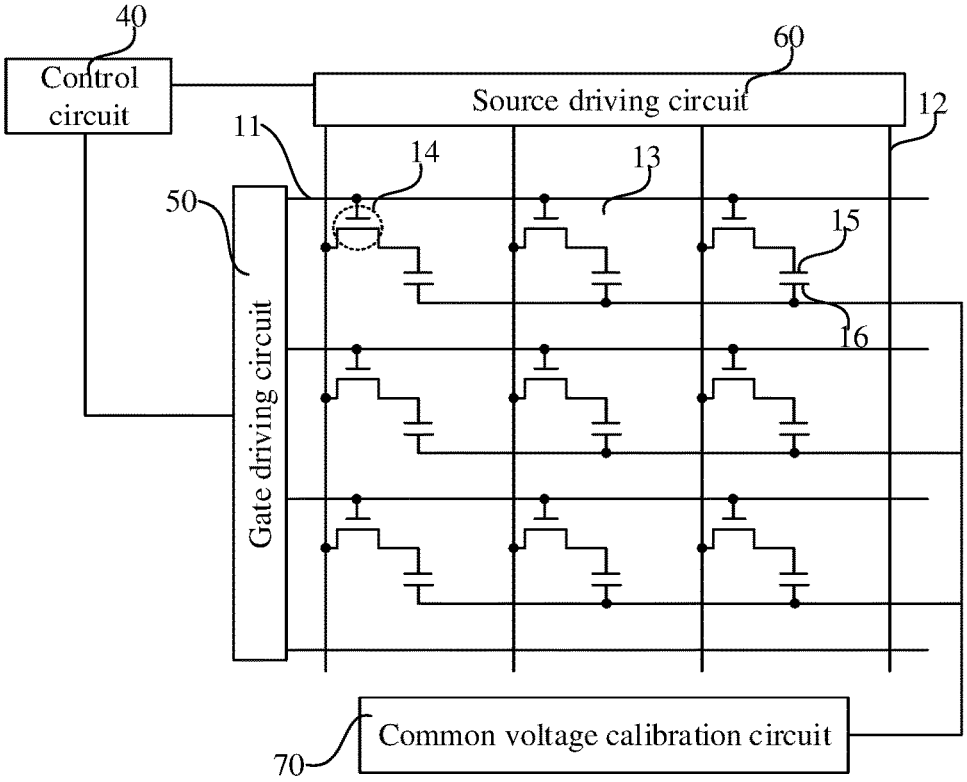
FIG. 3 is a schematic diagram of a display device according to an embodiment of the present disclosure.

FIG. 3 is a schematic diagram of a display device according to an embodiment of the present disclosure. As shown in FIG. 3, the liquid crystal display device further includes a control circuit 40, a gate drive circuit 50 and a source drive circuit 60. The control circuit 40 is configured to drive the gate drive circuit 50 and the source drive circuit 60 to operate. The gate driving circuit 50 is connected to the pixel units 13 through the gate lines 11, and the gate driving circuit 50 is used to control a progressive scanning of the gate lines 11 and provide gate scanning signals to the pixel array. The source driving circuit 60 is connected to the pixel units 13 through the data lines 12, and the source driving circuit 60 is used to provide data voltages to the pixel array through the data lines 12. In addition, the liquid crystal display device further includes a common voltage calibration circuit 70 which is used to provide a common voltage to the common electrodes 16, and the common voltage calibration circuit 70 will be described in detail later.

For example, the gate driving circuit 50 may be directly formed on the array substrate 10, or the gate driving circuit 50 may be integrated in a chip, and the chip is bonded to the array substrate 10. For example, the gate driving circuit 50 may be disposed on one side of the display panel, or disposed on both sides of the display panel to implement bilateral driving, and the embodiments of the present disclosure do not limit the manner in which the gate driving circuit 50 is disposed. For example, a gate drive circuit 50 may be disposed on one side of the display panel for driving gate lines in odd rows, and another gate drive circuit 50 may be disposed on another side of the display panel for driving gate lines in even rows. Similarly, the source driving circuit 60 may be directly formed on the array substrate 10, or the source driving circuit 60 may be integrated in a chip, and the chip is bonded to the array substrate 10. For example, the control circuit 40 may be disposed on a circuit board.

For example, the common voltage calibration circuit 70 may be fabricated on the array substrate 10 or a circuit board in conjunction with customer demand for the product. However, considering that if the common voltage calibration circuit 70 is formed on the array substrate 10, problems such as complicated wiring on the array substrate 10, difficulty in realization of a narrow frame of the display panel, and the like may be caused, the common voltage calibration circuit 70 may be disposed on a circuit board. For example, the common voltage calibration circuit 70 has a common voltage output terminal, and the common electrodes 16 of the display panel are electrically connected to the common voltage output terminal on the circuit board.

In a case where the liquid crystal display device operates, the control circuit 40 receives external signals and issues control signals which are used to drive the gate drive circuit 50 and the source drive circuit 60. Under the control of the control signals, the gate driving circuit 50 outputs scan signals, the scan signals are loaded through the gate lines 11 to the gate electrodes of the corresponding thin film transistors 14 to turn on the corresponding thin film transistors 14, the source driving circuit 60 outputs data voltages and the data voltages are loaded through the data lines 12 in columns to the source electrodes of the thin film transistors 14 which are turned-on, thereby the data voltages are transferred to the drain electrodes of the thin film transistors 14 and loaded to the pixel electrodes 15. In this case, the common voltage calibration circuit 70 generates a common voltage and the common voltage is loaded to the common electrodes 16, then electric fields are generated between the pixel electrodes 15 and the common electrodes 16 to control, for example, liquid crystal molecular deflection in the liquid crystal layer 30 shown in FIG. 1, thereby achieving image display.

It should be noted that, for the purpose of clarity and conciseness, the embodiments of the present disclosure do not show the overall structure of the liquid crystal display device. In order to realize the necessary functions of the display device, the skilled in the art may set other structures not shown according to the specific application scenario, which is not limited by the embodiments of the present disclosure.

Figure 4:
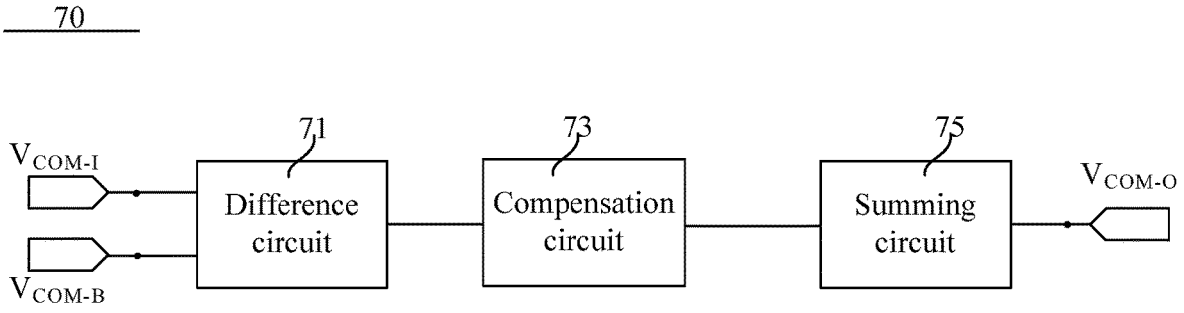
FIG. 4 is a schematic diagram of a common voltage calibration circuit according to an embodiment of the present disclosure.

FIG. 4 is a schematic diagram of a common voltage calibration circuit according to an embodiment of the present disclosure. As shown in FIG. 4, a common voltage calibration circuit 70 includes a difference circuit 71, a compensation circuit 73 and a summing circuit 75.

For example, the difference circuit 71 is connected to a common voltage input terminal $V_{COM-I}$ and a common voltage feedback terminal $V_{COM-B}$, and the difference circuit 71 is configured to perform a difference processing on a common voltage provided by the common voltage input terminal $V_{COM-I}$ and a feedback common voltage provided by the common voltage feedback terminal $V_{COM-B}$ and output a difference value signal. For example, the difference value signal may be output through an output terminal of the difference circuit 71.

The compensation circuit 73 is connected to the summing circuit 75 and connected to an output terminal of the difference circuit 71, and the compensation circuit 73 is configured to receive the difference value signal and compensate the common voltage based on the difference value signal. For example, the difference value signal is obtained by the difference circuit 71. For example, the compensation circuit 73 includes an output terminal, and the output terminal of the compensation circuit is connected to an input terminal of the summing circuit 75, such that a compensation signal output by the compensation circuit 73 can be input into the summing circuit 75 for superposition.

The summing circuit 75 is connected to the compensation circuit 73 and the common voltage output terminal $V_{COM-O}$, and the summing circuit 75 is configured to superimpose at least two compensation signals output by the compensation circuit 73 and output the superimposition result through the common voltage output terminal $V_{COM-O}$. For example, the compensation signal is a compensated common voltage value obtained by inversely amplifying, integrating and/or differentiating the difference value signal received by the compensation circuit 73.

For example, the compensation circuit 73 includes at least two of a proportional compensation sub-circuit, an integral compensation sub-circuit and a differential compensation sub-circuit.

For example, the proportional compensation sub-circuit is connected to the difference circuit 71 and the summing circuit 75, and the proportional compensation sub-circuit is configured to inversely amplify the difference value signal output by the difference circuit 71, thereby achieving fast response and quickly eliminating the pull action of cross-talk or the coupling effect of signal on the $V_{COM}$.

The integral compensation sub-circuit is connected to the difference circuit 71 and the summing circuit 75, and the integral compensation sub-circuit is configured to perform an integration processing on the difference value signal output by the difference circuit 71 to control the accuracy of the common voltage. Because the integral compensation sub-circuit can realize a continuous accumulation of the deviation of the $V_{COM}$, the steady-state error of the $V_{COM}$ can be eliminated, and the control on the accuracy of the $V_{COM}$ can be realized, thereby improving the stability of the $V_{COM}$.

The differential compensation sub-circuit is connected to the difference circuit 71 and the summing circuit 75, and the differential compensation sub-circuit is configured to generate an adjustment signal according to the difference value signal output by the difference circuit 71 to adjust the common voltage, thereby effectively suppressing the overshoot of the $V_{COM}$ by the proportional compensation sub-circuit, speeding up adjustment and predicting changes of the $V_{COM}$.

Figure 5:
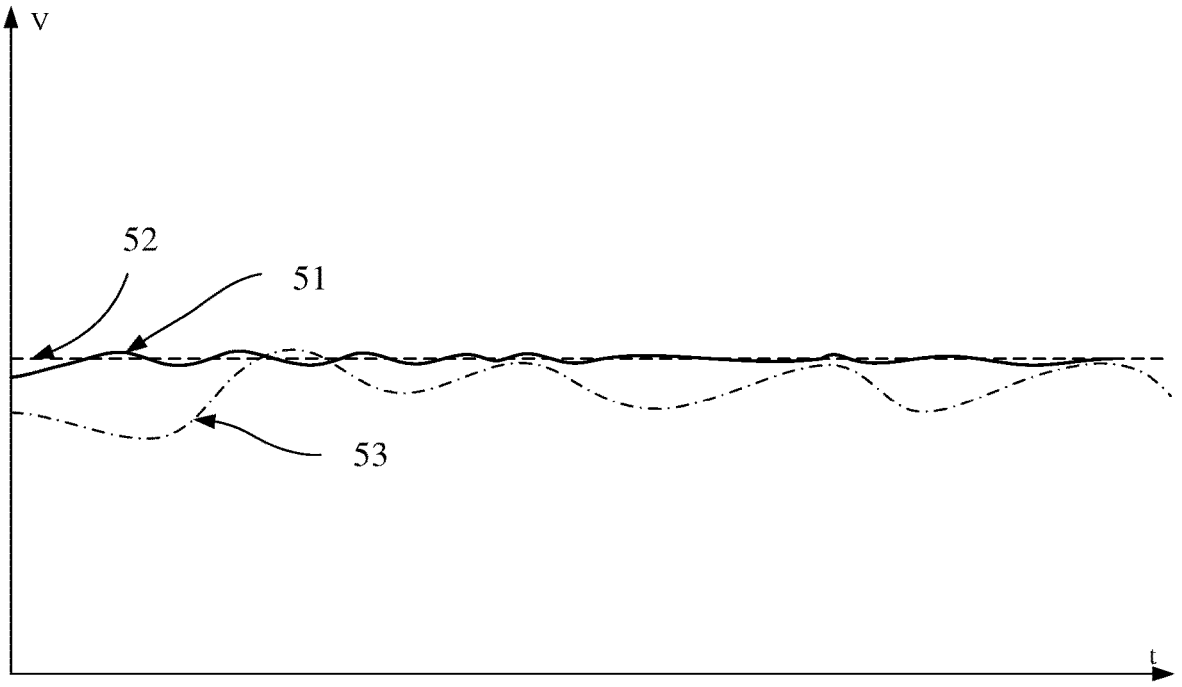
FIG. 5 is a waveform diagram of a common voltage under different conditions according to an embodiment of the present disclosure.

It should be noted that the common voltage provided by the common voltage input terminal $V_{COM-I}$ (hereinafter referred to as a desired voltage for convenience of understanding) is generated by a corresponding circuit or a chip, and is a voltage (for example, the dashed line 52 shown in FIG. 5) that is desired to be input to the common electrode 16; that is, the dashed line 52 in FIG. 5 represents the common voltage provided by the common voltage input terminal $V_{COM-I}$ and desired to be input to the common electrode 16. For example, in a case where the common voltage calibration circuit 70 provided by the embodiment of the present disclosure is not provided, during a transmission process of the desired voltage, the desired voltage may be pulled due to load loss generated during signal transmission and interference by coupling between signals, and the desired voltage originally output by the common voltage input terminal $V_{COM-I}$ is changed, that is, the common voltage that is obtained from the common voltage feedback terminal $V_{COM-I}$ and actually input to the common electrode 16, that is, the feedback common voltage, undergoes a large change (for example, the dot and dash line 53 shown in FIG. 5), thereby phenomenon such as afterimage of the display panel and the like is generated, which affects the display quality of the display panel; that is, the dot and dash line 53 in FIG. 5 represents the feedback common voltage from the common voltage feedback terminal $V_{COM-B}$ without the common voltage calibration circuit 70. Therefore, through providing the common voltage calibration circuit 70 provided by any embodiment of the present disclosure, the common voltage actually input to the common electrode 16 may change as little as possible with respect to the desired voltage, thereby ensuring the display quality of the display panel.

Figure 6:
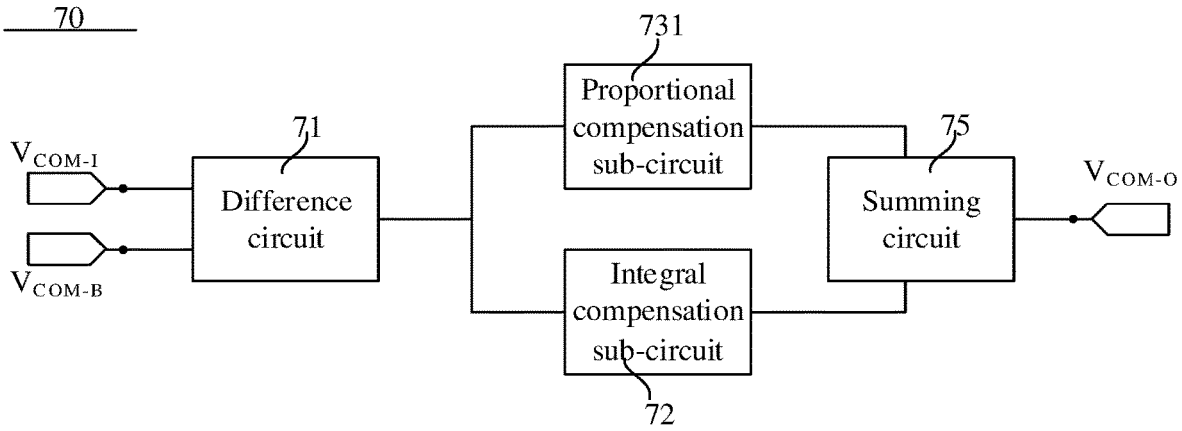
FIG. 6 is a schematic diagram of an example of a common voltage calibration circuit according to an embodiment of the present disclosure.

FIG. 6 is a schematic diagram of an example of a common voltage calibration circuit according to an embodiment of the present disclosure. For example, in this example, the compensation circuit 73 includes an integral compensation sub-circuit 72 and a proportional compensation sub-circuit 731. As shown in FIG. 6, the common voltage calibration circuit 70 includes a difference circuit 71, the integral compensation sub-circuit 72, the proportional compensation sub-circuit 731 and a summing circuit 75.

For example, an input terminal of the difference circuit 71 is connected to a common voltage input terminal $V_{COM-I}$ and a common voltage feedback terminal $V_{COM-B}$ for obtaining a voltage difference value between the common voltage input terminal $V_{COM-I}$ and the common voltage feedback terminal $V_{COM-B}$, and the voltage difference value is output through the an output terminal of the difference circuit 71.

For example, an input terminal of the integral compensation sub-circuit 72 is connected to an output terminal of the difference circuit 71, and an output terminal of the integral compensation sub-circuit is connected to an input terminal of the summing circuit 75, the integral compensation sub-circuit 72 is used to control the accuracy of the common voltage according to the output result of the difference circuit 71 and output an integrated result to the summing circuit 75.

For example, an input terminal of the proportional compensation sub-circuit 731 is connected to an output terminal of the difference circuit 71, and an output terminal of the proportional compensation sub-circuit is connected to an input terminal of the summing circuit 75, the proportional compensation sub-circuit 731 is used to inversely amplify output results of the difference circuit 71.

For example, an output terminal of the summing circuit 75 is connected to the common voltage output terminal $V_{COM-O}$, the proportional compensation sub-circuit 731 and the integral compensation sub-circuit 72, the summing circuit 75 is used to superimpose the output results of the integral compensation sub-circuit 72 and the proportional compensation sub-circuit 731 and output the superimposition result.

The common voltage calibration circuit 70 provided by the example obtains, through the difference circuit 71, the voltage difference value between the common voltage input terminal $V_{COM-I}$ and the common voltage feedback terminal $V_{COM-B}$, and achieves continuous accumulation of the voltage difference value output by the difference circuit 71 through the integral compensation sub-circuit 72, thereby effectively achieving an accuracy control on the common voltage, reducing the steady-state error between the common voltage and a desired voltage actually input to a common electrode 16 during a common voltage calibration process; inversely amplifying the voltage difference value output by the difference circuit 71 through the proportional compensation sub-circuit 731 can achieve real-time suppression on the pull action on the common voltage during the common voltage transfer process and attenuate the fluctuation of the common voltage actually input to the common electrode 16. On the basis of this, the output results of the integral compensation sub-circuit 72 and the proportional compensation sub-circuit 731 are superimposed and output by the summing circuit 75, such that the common voltage calibration circuit provided by the embodiments of the present disclosure can satisfy the requirements for control accuracy, response speed and stability of the common voltage actually input to the common electrode 16, thereby effectively alleviating cross-talk and afterimage, and improving display quality of the display panel.

Figure 7:
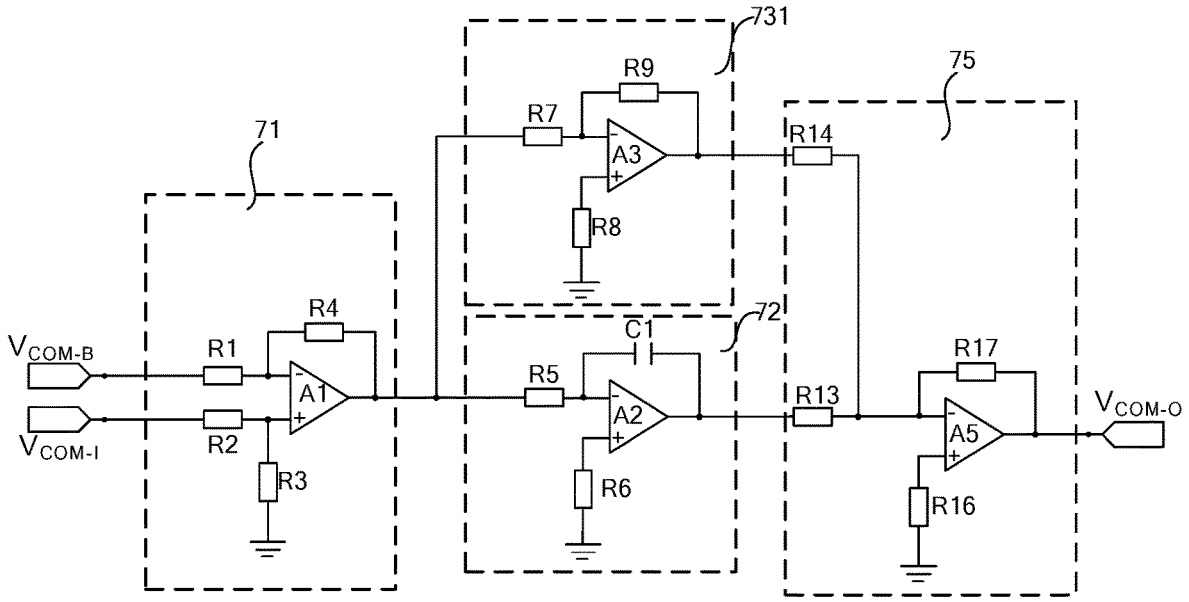
FIG. 7 is a schematic diagram of a circuit structure of a specific implementation example of the common voltage calibration circuit shown in FIG. 6.

FIG. 7 is a schematic diagram of a circuit structure of a specific implementation example of the common voltage calibration circuit shown in FIG. 6. As shown in FIG. 7, the difference circuit 71 may be implemented by including a first amplifier A1, a first resistor R1, a second resistor R2, a third resistor R3 and a fourth resistor R4.

One terminal of the first resistor R1 is connected to the common voltage feedback terminal $V_{COM-B}$, and another terminal of the first resistor R1 is connected to an inverting input terminal of the first amplifier A1.

One terminal of the second resistor R2 is connected to the common voltage input terminal $V_{COM-I}$, and another terminal of the second resistor R2 is connected to a non-inverting input terminal of the first amplifier A1.

One terminal of the third resistor R3 is connected to a non-inverting input terminal of the first amplifier A1, and another terminal of the third resistor R3 is grounded.

One terminal of the fourth resistor R4 is connected to an inverting input terminal of the first amplifier A1, and another terminal of the fourth resistor R4 is connected to an output terminal of the first amplifier A1. For example, the output terminal of the first amplifier A1 is the output terminal of the difference circuit 71.

As shown in FIG. 7, the integral compensation sub-circuit 72 may be implemented by including a second amplifier A2, a fifth resistor R5, a sixth resistor R6 and a first capacitor C1.

One terminal of the fifth resistor R5 is connected to an output terminal of the difference circuit 71 (i.e., the output terminal of the first amplifier A1), and another terminal of the fifth resistor R5 is connected to an inverting input terminal of the second amplifier A2. For example, in a case where the difference circuit 71 includes the first amplifier A1, the first resistor R1, the second resistor R2, the third resistor R3 and the fourth resistor R4, one terminal of the fifth resistor R5 is connected to the output terminal of the first amplifier A1.

One terminal of the sixth resistor R6 is connected to a non-inverting input terminal of the second amplifier A2, and another terminal of the sixth resistor R6 is grounded.

One terminal of the first capacitor C1 is connected to an inverting input terminal of the second amplifier A2, and another terminal of the first capacitor C1 is connected to an output terminal of the second amplifier A2.

Figure 8:
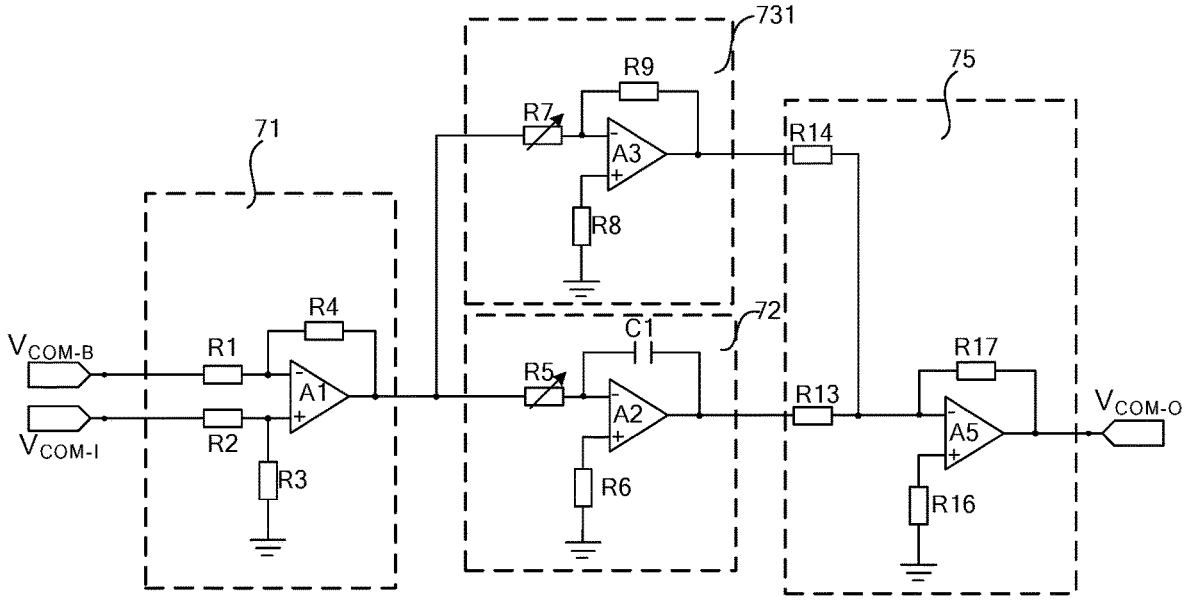
FIG. 8 is a schematic diagram of a circuit structure of another specific implementation example of the common voltage calibration circuit shown in FIG. 6.

It can be seen from the specific circuit of the integral compensation sub-circuit 72 that the output of the integral compensation sub-circuit 72 can be controlled by adjusting the resistance of the fifth resistor R5 and the capacitance of the first capacitor C1. On this basis, as shown in FIG. 8, for example, the fifth resistor R5 is an adjustable resistor, such that the output of the integral compensation sub-circuit 72 can be adjusted by adjusting the resistance of the fifth resistor R5 in combination with the characteristics of different panels.

As shown in FIG. 7, the proportional compensation sub-circuit 731 includes a third amplifier A3, a seventh resistor R7, an eighth resistor R8 and a ninth resistor R9.

One terminal of the seventh resistor R7 is connected to an output terminal of the difference circuit 71, and another terminal of the seventh resistor R7 is connected to an inverting input terminal of the third amplifier A3. For example, in a case where the difference circuit 71 includes the first amplifier A1, the first resistor R1, the second resistor R2, the third resistor R3 and the fourth resistor R4, one terminal of the seventh resistor R7 is connected to the output terminal of the first amplifier A1.

One terminal of the eighth resistor R8 is connected to a non-inverting input terminal of the third amplifier A3, and another terminal of the eighth resistor R8 is grounded.

One terminal of the ninth resistor R9 is connected to an inverting input terminal of the third amplifier A3, and another terminal of the ninth resistor R9 is connected to an output terminal of the third amplifier A3.

It can be seen from the specific circuit of the proportional compensation sub-circuit 731 that the output of the proportional compensation sub-circuit 731 can be controlled by adjusting the resistance of the seventh resistor R7 and the ninth resistor R9. On this basis, as shown in FIG. 8, for example, the seventh resistor R7 is an adjustable resistor, such that the output of the compensation circuit 73 can be adjusted by adjusting the resistance of the seventh resistor R7 in combination with the characteristics of different panels.

As shown in FIG. 7 and FIG. 8, the summing circuit 75 includes a fifth amplifier A5, a thirteenth resistor R13, a fourteenth resistor R14, a sixteenth resistor R16 and a seventeenth resistor R17.

One terminal of the thirteenth resistor R13 is connected to an output terminal of the proportional compensation sub-circuit 72, and another terminal of the thirteenth resistor R13 is connected to an inverting input terminal of the fifth amplifier A5. For example, in a case where the integral compensation sub-circuit 72 includes the second amplifier A2, the fifth resistor R5, the sixth resistor R6 and the first capacitor C1, one terminal of the thirteenth resistor R13 is connected to an output terminal of the second amplifier A2.

One terminal of the fourteenth resistor R14 is connected to an output terminal of the differential compensation sub-circuit 731, and another terminal of the fourteenth resistor R14 is connected to an inverting input terminal of the fifth amplifier A5. For example, in a case where the proportional compensation sub-circuit 731 includes the third amplifier A3, the seventh resistor R7, the eighth resistor R8 and the ninth resistor R9, one terminal of the fourteenth resistor R14 is connected to an output terminal of the third amplifier A3.

One terminal of the sixteenth resistor R16 is connected to a non-inverting input terminal of the fifth amplifier A5, and another terminal of the sixteenth resistor R16 is grounded.

One terminal of the seventeenth resistor R17 is connected to an inverting input terminal of the fifth amplifier A5, and another terminal of the seventeenth resistor R17 is connected to an output terminal of the fifth amplifier A5. For example, an output terminal of the fifth amplifier A5 is connected to the common voltage output terminal $V_{COM-O}$.

Figure 9:
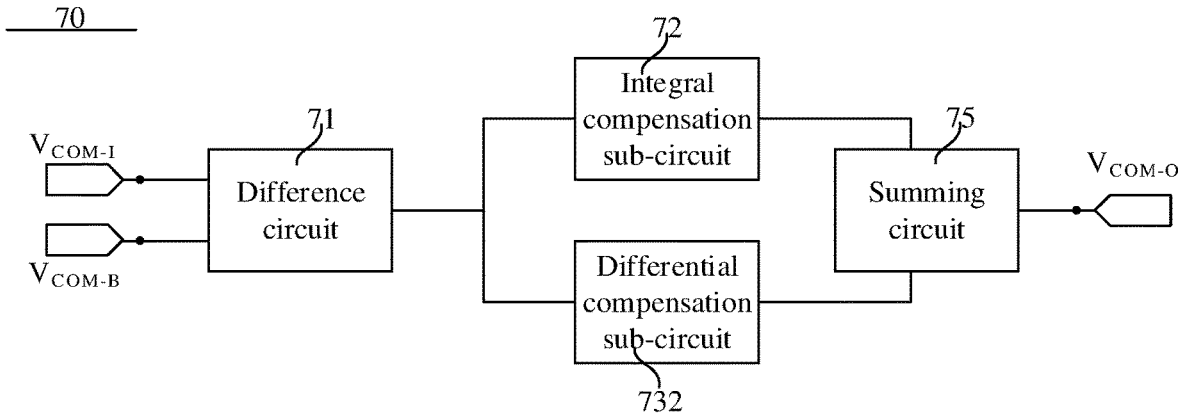
FIG. 9 is a schematic diagram of another example of a common voltage calibration circuit according to an embodiment of the present disclosure.

FIG. 9 is a schematic diagram of another example of a common voltage calibration circuit according to an embodiment of the present disclosure. For example, the common voltage calibration circuit 70 in this example is similar in structure to the common voltage calibration circuit 70 shown in FIG. 6, with the difference that the compensation circuit 73 includes an integral compensation sub-circuit 72 and a differential compensation sub-circuit 732. As shown in FIG. 9, the common voltage calibration circuit 70 includes a difference circuit 71, an integral compensation sub-circuit 72, a differential compensation sub-circuit 732 and a summing circuit 75.

An input terminal of the difference circuit 71 is connected to a common voltage input terminal $V_{COM-I}$ and a common voltage feedback terminal $V_{COM-B}$ for obtaining a voltage difference value between the common voltage input terminal $V_{COM-I}$ and the common voltage feedback terminal $V_{COM-B}$, and the voltage difference value is output through the output terminal of the difference circuit 71.

The input terminal of the integral compensation sub-circuit 72 is connected to an output terminal of the difference circuit 71, and an output terminal of the integral compensation sub-circuit is connected to an input terminal of the summing circuit 75, the integral compensation sub-circuit 72 is used to control the accuracy of the common voltage according to an output result of the difference circuit 71.

The input terminal of the differential compensation sub-circuit 732 is connected to an output terminal of the difference circuit 71, and an output terminal of the differential compensation sub-circuit is connected to an input terminal of the summing circuit 75, the differential compensation sub-circuit 732 is used to generate adjustment signals according to output results of the difference circuit 71 to adjust the common voltage.

An output terminal of the summing circuit 75 is connected to the common voltage output terminal $V_{COM-O}$, the integral compensation sub-circuit 72 and the differential compensation sub-circuit 732, and the summing circuit 75 is used to superimpose the output results of the integral compensation sub-circuit 72 and the differential compensation sub-circuit 732 and output the superimposition result.

The common voltage calibration circuit provided by the example obtains the voltage difference value between the common voltage input terminal $V_{COM-I}$ and the common voltage feedback terminal $V_{COM-B}$ through the difference circuit 71, and achieves continuous accumulation of the voltage difference value output by the difference circuit 71 through the integral compensation sub-circuit 72, thereby effectively achieving the accuracy control on the common voltage, reducing the steady-state error between the common voltage and a desired voltage actually input to a common electrode 16 during a common voltage calibration process; the common voltage can be adjusted and compensated and the change of the common voltage can be predicted through the differential compensation sub-circuit 732, thereby effectively suppressing the overshoot and further improving the stability of the common voltage. On the basis of this, the output results of the integral compensation sub-circuit 72 and the differential compensation sub-circuit 732 are superimposed and output by the summing circuit 75, such that the common voltage calibration circuit provided by the embodiments of the present disclosure can satisfy the requirements for the control accuracy and stability of the common voltage, thereby effectively alleviating cross-talk and afterimage, and improving the display quality of the display panel.

Figure 10:
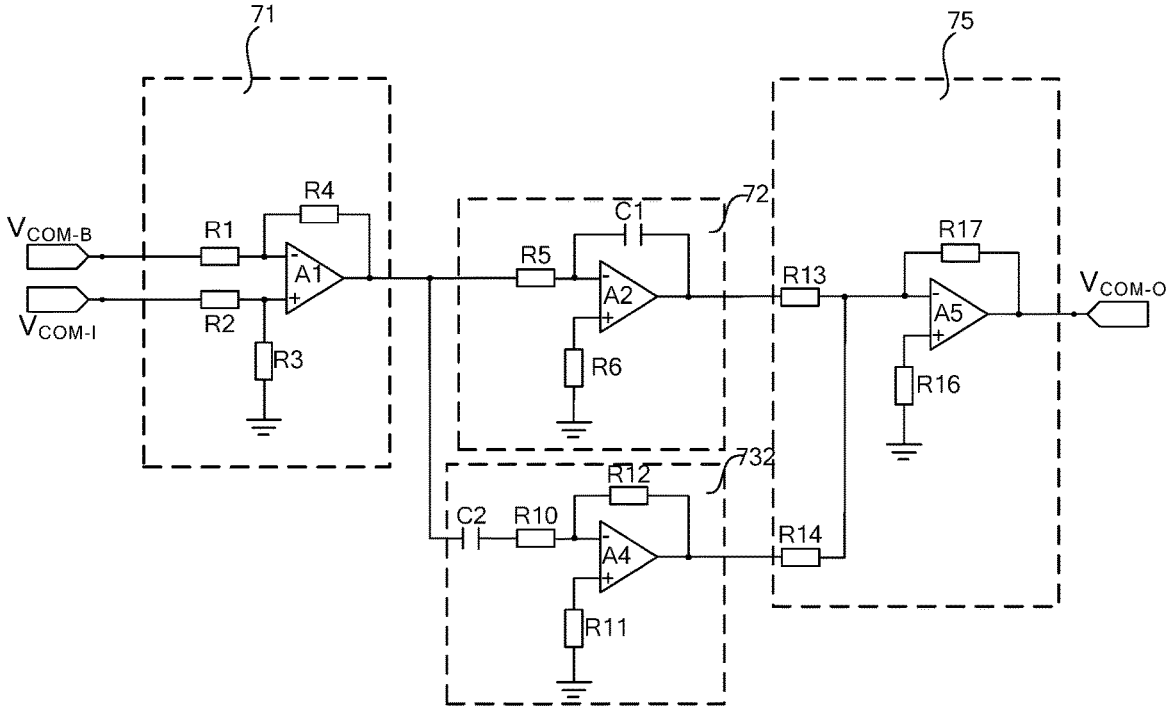
FIG. 10 is a schematic diagram of a circuit structure of a specific implementation example of the common voltage calibration circuit shown in FIG. 9.

FIG. 10 is a schematic diagram of a circuit structure of a specific implementation example of the common voltage calibration circuit shown in FIG. 9. As shown in FIG. 10, the difference circuit 71 includes a first amplifier A1, a first resistor R1, a second resistor R2, a third resistor R3, and a fourth resistor R4.

One terminal of the first resistor R1 is connected to the common voltage feedback terminal $V_{COM-B}$, and another terminal of the first resistor R1 is connected to an inverting input terminal of the first amplifier A1.

One terminal of the second resistor R2 is connected to the common voltage input terminal $V_{COM-I}$, and another terminal of the second resistor R2 is connected to a non-inverting input terminal of the first amplifier A1.

One terminal of the third resistor R3 is connected to a non-inverting input terminal of the first amplifier A1, and another terminal of the third resistor R3 is grounded.

One terminal of the fourth resistor R4 is connected to an inverting input terminal of the first amplifier A1, and another terminal of the fourth resistor R4 is connected to an output terminal of the first amplifier A1.

As shown in FIG. 10, the integral compensation sub-circuit 72 may be implemented by including a second amplifier A2, a fifth resistor R5, a sixth resistor R6 and a first capacitor C1.

One terminal of the fifth resistor R5 is connected to an output terminal of the difference circuit 71, and another terminal of the fifth resistor R5 is connected to an inverting input terminal of the second amplifier A2. For example, in a case where the difference circuit 71 includes the first amplifier A1, the first resistor R1, the second resistor R2, the third resistor R3 and the fourth resistor R4, one terminal of the fifth resistor R5 is connected to the output terminal of the first amplifier A1.

One terminal of the sixth resistor R6 is connected to a non-inverting input terminal of the second amplifier A2, and another terminal of the sixth resistor R6 is grounded.

One terminal of the first capacitor C1 is connected to an inverting input terminal of the second amplifier A2, and another terminal of the first capacitor C1 is connected to an output terminal of the second amplifier A2.

Figure 11:
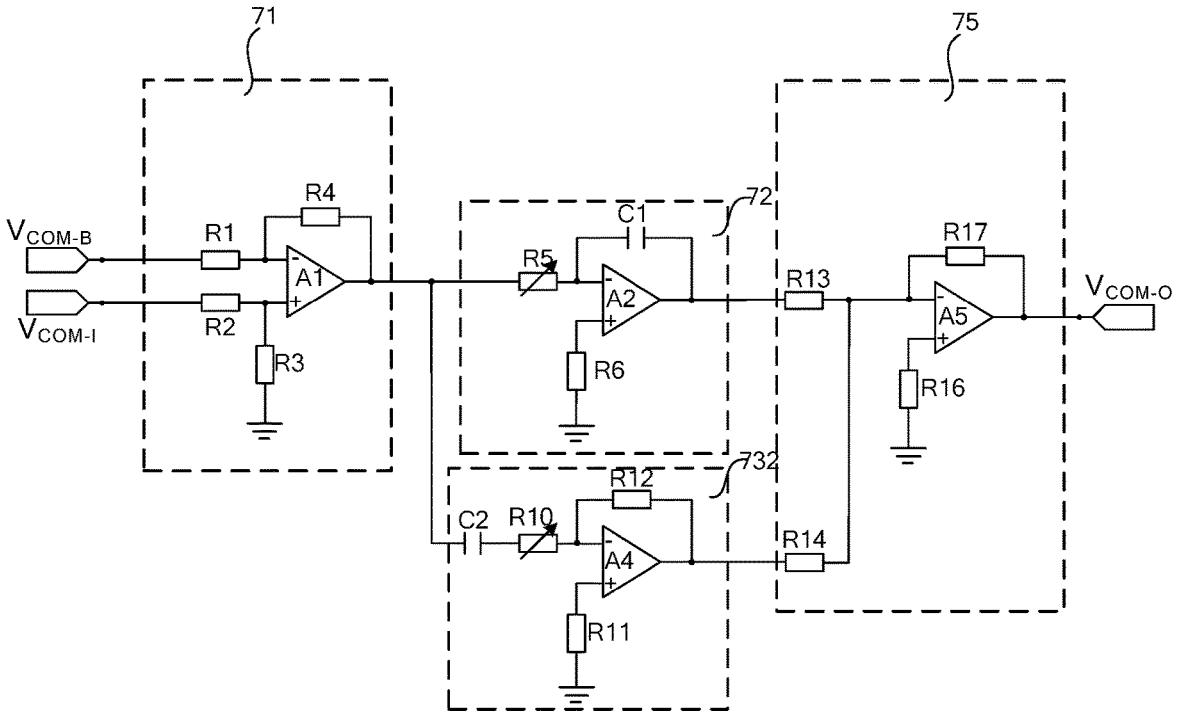
FIG. 11 is a schematic diagram of a circuit structure of a specific implementation example of the common voltage calibration circuit shown in FIG. 9.

It can be seen from the specific circuit of the integral compensation sub-circuit 72 that the output of the integral compensation sub-circuit 72 can be controlled by adjusting the resistance of the fifth resistor R5 and the capacitance of the first capacitor C1. On this basis, as shown in FIG. 11, for example, the fifth resistor R5 is an adjustable resistor, such that the output of the integral compensation sub-circuit 72 can be adjusted by adjusting the resistance of the fifth resistor R5 in combination with the characteristics of different panels.

As shown in FIG. 10, the differential compensation sub-circuit 732 includes a fourth amplifier A4, a tenth resistor R10, an eleventh resistor R11, a twelfth resistor R12 and a second capacitor C2.

One terminal of the second capacitor C2 is connected to an output terminal of the difference circuit 71, and another terminal of the second capacitor C2 is connected to a terminal of the tenth resistor R10. For example, in a case where the difference circuit 71 includes the first amplifier A1, the first resistor R1, the second resistor R2, the third resistor R3 and the fourth resistor R4, one terminal of the second capacitor C2 is connected to an output terminal of the first amplifier A1.

Another terminal of the tenth resistor R10 is connected to an inverting input terminal of the fourth amplifier A4.

One terminal of the eleventh resistor R11 is connected to a non-inverting input terminal of the fourth amplifier A4, and another terminal of the eleventh resistor R11 is grounded.

One terminal of the twelfth resistor R12 is connected to an inverting input terminal of the fourth amplifier A4, and another terminal of the twelfth resistor R12 is connected to an output terminal of the fourth amplifier A4.

It can be seen from the specific circuit of the differential compensation sub-circuit 732 that the output of the differential compensation sub-circuit 732 can be controlled by adjusting the resistance of the tenth resistor R10 and the twelfth resistor R12 and the capacitance of the second capacitor C2. On this basis, as shown in FIG. 11, for example, the tenth resistor R10 is an adjustable resistor, such that the output of the differential compensation sub-circuit 732 can be adjusted by adjusting the resistance of the tenth resistor R10 in combination with the characteristics of different panels.

As shown in FIG. 10 and FIG. 11, the summing circuit 75 includes a fifth amplifier A5, a thirteenth resistor R13, a fourteenth resistor R14, a sixteenth resistor R16 and a seventeenth resistor R17.

One terminal of the thirteenth resistor R13 is connected to an output terminal of the proportional compensation sub-circuit 72, and another terminal of the thirteenth resistor R13 is connected to an inverting input terminal of the fifth amplifier A5. For example, in a case where the integral compensation sub-circuit 72 includes the second amplifier A2, the fifth resistor R5, the sixth resistor R6 and the first capacitor C1, one terminal of the thirteenth resistor R13 is connected to an output terminal of the second amplifier A2.

One terminal of the fourteenth resistor R14 is connected to an output terminal of the differential compensation sub-circuit 732, and another terminal of the fourteenth resistor R14 is connected to an inverting input terminal of the fifth amplifier A5. For example, in a case where the differential compensation sub-circuit 732 includes a fourth amplifier A4, a tenth resistor R10, an eleventh resistor R11, a twelfth resistor R12 and a second capacitor C2, one terminal of the fourteenth resistor R14 is connected to an output terminal of the fourth amplifier A4.

One terminal of the sixteenth resistor R16 is connected to a non-inverting input terminal of the fifth amplifier A5, and another terminal of the sixteenth resistor R16 is grounded.

One terminal of the seventeenth resistor R17 is connected to an inverting input terminal of the fifth amplifier A5, and another terminal of the seventeenth resistor R17 is connected to an output terminal of the fifth amplifier A5. For example, an output terminal of the fifth amplifier A5 is connected to the common voltage output terminal $V_{COM-O}$.

Figure 12:
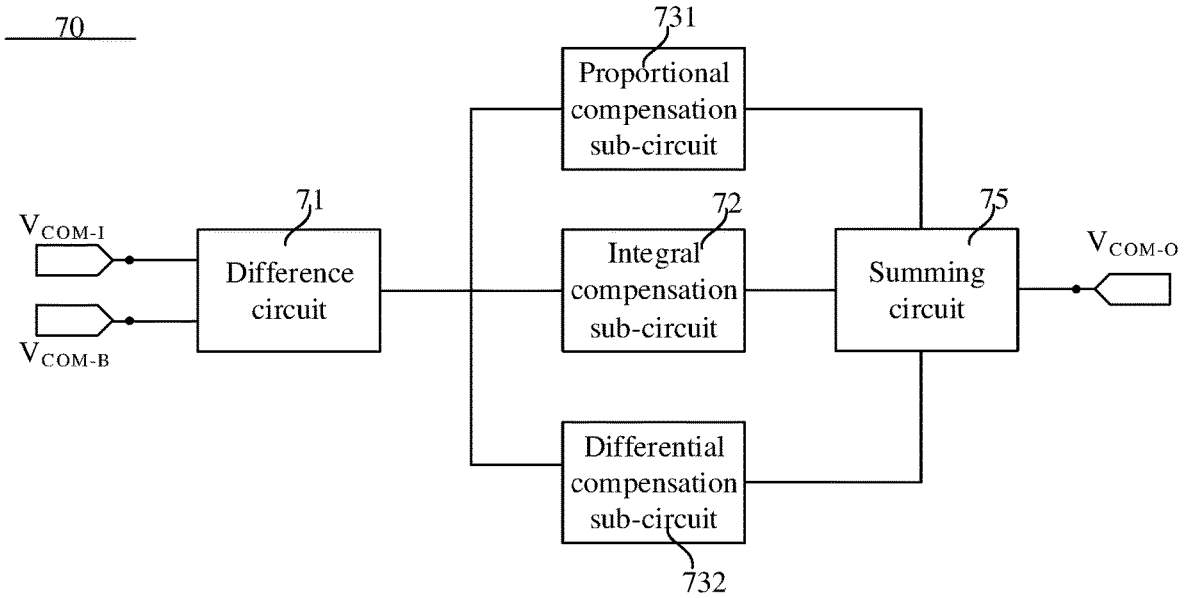
FIG. 12 is a schematic diagram of another example of a common voltage calibration circuit according to an embodiment of the present disclosure.

FIG. 12 is a schematic diagram of another example of a common voltage calibration circuit according to an embodiment of the present disclosure. For example, the common voltage calibration circuit 70 in this example is similar in structure to the common voltage calibration circuit 70 shown in FIG. 9, with the difference that the compensation circuit 73 includes a proportional compensation sub-circuit 731, an integral compensation sub-circuit 72 and a differential compensation sub-circuit 732. As shown in FIG. 12, the common voltage calibration circuit 70 includes a difference circuit 71, an integral compensation sub-circuit 72, a proportional compensation sub-circuit 731, a differential compensation sub-circuit 732 and a summing circuit 75.

An input terminal of the difference circuit 71 is connected to a common voltage input terminal $V_{COM-I}$ and a common voltage feedback terminal $V_{COM-B}$ for obtaining a voltage difference value between the common voltage input terminal $V_{COM-I}$ and the common voltage feedback terminal $V_{COM-B}$, and the voltage difference value is output through an output terminal of the difference circuit 71.

The input terminal of the integral compensation sub-circuit 72 is connected to an output terminal of the difference circuit 71, and an output terminal of the integral compensation sub-circuit is connected to an input terminal of the summing circuit 75, the integral compensation sub-circuit 72 is used to control the accuracy of the common voltage according to an output result of the difference circuit 71.

The input terminal of the proportional compensation sub-circuit 731 is connected to an output terminal of the difference circuit 71, and an output terminal of the proportional compensation sub-circuit is connected to an input terminal of the summing circuit 75, and the proportional compensation sub-circuit 731 is used to inversely amplify the output result of the difference circuit 71.

The input terminal of the differential compensation sub-circuit 732 is connected to an output terminal of the difference circuit 71, and an output terminal of the differential compensation sub-circuit is connected to an input terminal of the summing circuit 75, the differential compensation sub-circuit 732 is used to generate adjustment signals according to output results of the difference circuit 71, to adjust and compensate the common voltage.

An output terminal of the summing circuit 75 is connected to the common voltage output terminal $V_{COM-O}$, the integral compensation sub-circuit 72, the proportional compensation sub-circuit 731 and the differential compensation sub-circuit 732, the summing circuit 75 is used to superimpose the output results of the integral compensation sub-circuit 72, the proportional compensation sub-circuit 731 and the differential compensation sub-circuit 732 and output the superimposition result.

The common voltage calibration circuit 70 provided by the example obtains, through the difference circuit 71, the voltage difference value between the common voltage input terminal $V_{COM-I}$ and the common voltage feedback terminal $V_{COM-B}$, and achieves continuous accumulation of the voltage difference value output by the difference circuit 71 through the integral compensation sub-circuit 72, thereby effectively achieving the accuracy control on the common voltage, reducing a steady-state error between the common voltage and a desired voltage actually input to a common electrode 16 during a common voltage calibration process; inversely amplifying the voltage difference value output by the difference circuit 71 through the proportional compensation sub-circuit 731, achieving real-time suppression on the pull action on the common voltage during the common voltage transfer process and attenuating fluctuation of the common voltage actually input to the common electrode 16; the common voltage can be adjusted and compensated, and the change of the common voltage can be predicted through the differential compensation sub-circuit 732, thereby effectively suppressing the overshoot and further improving the stability of the common voltage. On the basis of this, the output results of the integral compensation sub-circuit 72, the proportional compensation sub-circuit 731 and the differential compensation sub-circuit 732 are superimposed and output by the summing circuit 75, such that the common voltage calibration circuit provided by the embodiments of the present disclosure can satisfy the requirements for control accuracy, response speed and stability of the common voltage, thereby effectively alleviating cross-talk and afterimage, and improving display quality of the display panel.

Figure 13:
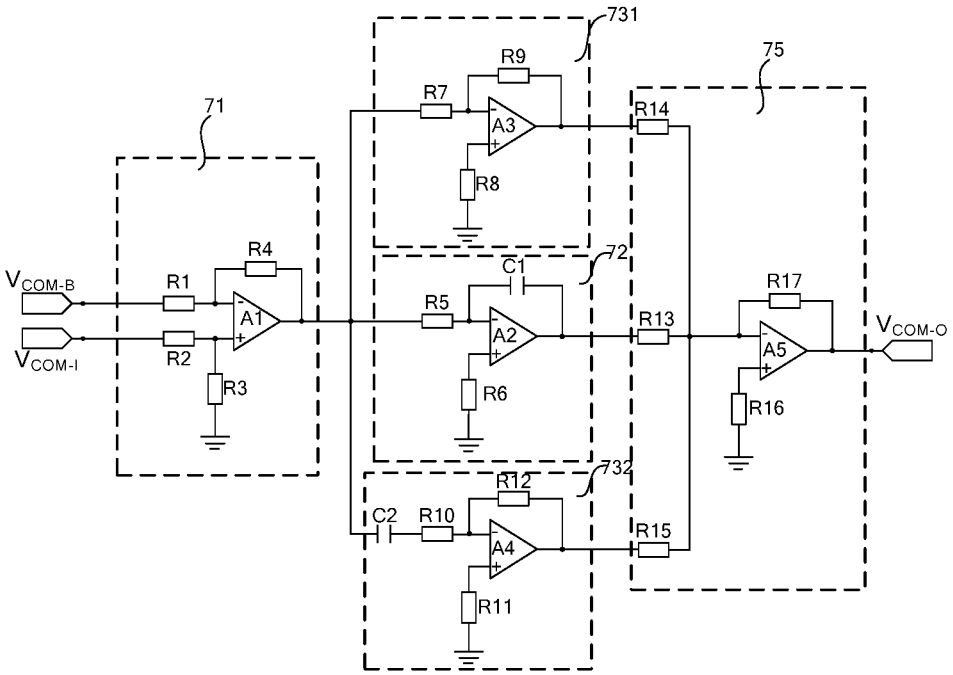
FIG. 13 is a schematic diagram of a circuit structure of a specific implementation example of the common voltage calibration circuit shown in FIG. 12.

FIG. 13 is a schematic diagram of a circuit structure of a specific implementation example of the common voltage calibration circuit shown in FIG. 12. As shown in FIG. 13, the difference circuit 71 includes a first amplifier A1, a first resistor R1, a second resistor R2, a third resistor R3, and a fourth resistor R4.

One terminal of the first resistor R1 is connected to the common voltage feedback terminal $V_{COM-B}$, and another terminal of the first resistor R1 is connected to an inverting input terminal of the first amplifier A1.

One terminal of the second resistor R2 is connected to the common voltage input terminal $V_{COM-I}$, and another terminal of the second resistor R2 is connected to a non-inverting input terminal of the first amplifier A1.

One terminal of the third resistor R3 is connected to a non-inverting input terminal of the first amplifier A1, and another terminal of the third resistor R3 is grounded.

One terminal of the fourth resistor R4 is connected to an inverting input terminal of the first amplifier A1, and another terminal of the fourth resistor R4 is connected to an output terminal of the first amplifier A1.

As shown in FIG. 13, the integral compensation sub-circuit 72 may be implemented by including a second amplifier A2, a fifth resistor R5, a sixth resistor R6 and a first capacitor C1.

One terminal of the fifth resistor R5 is connected to an output terminal of the difference circuit 71, and another terminal of the fifth resistor R5 is connected to an inverting input terminal of the second amplifier A2. For example, in a case where the difference circuit 71 includes the first amplifier A1, the first resistor R1, the second resistor R2, the third resistor R3 and the fourth resistor R4, one terminal of the fifth resistor R5 is connected to the output terminal of the first amplifier A1.

One terminal of the sixth resistor R6 is connected to a non-inverting input terminal of the second amplifier A2, and another terminal of the sixth resistor R6 is grounded.

One terminal of the first capacitor C1 is connected to an inverting input terminal of the second amplifier A2, and another terminal of the first capacitor C1 is connected to an output terminal of the second amplifier A2.

Figure 14:
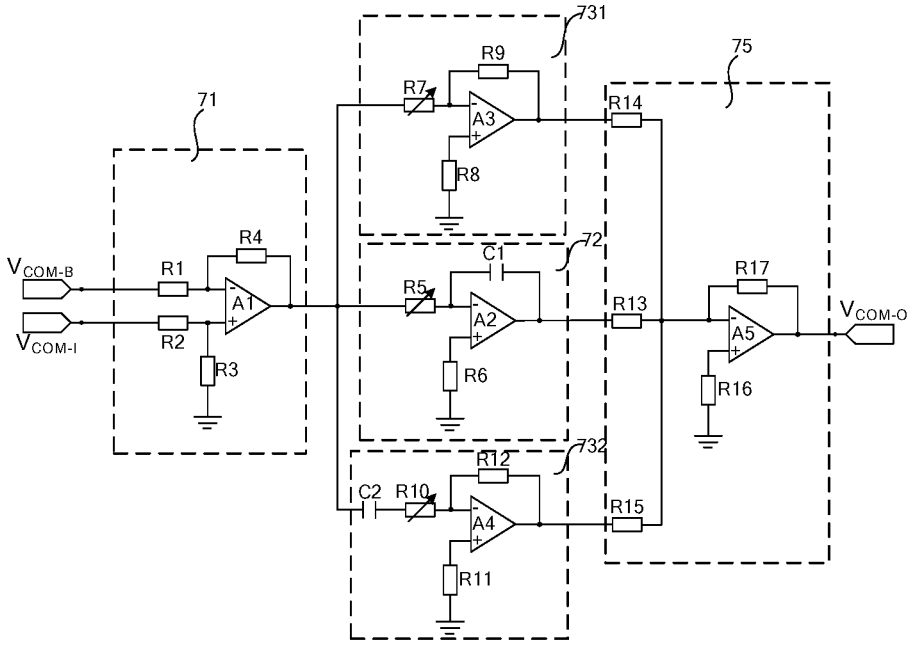
FIG. 14 is a schematic diagram showing the circuit structure of a specific implementation example of the common voltage calibration circuit shown in FIG. 12.

It can be seen from the specific circuit of the integral compensation sub-circuit 72 that the output of the integral compensation sub-circuit 72 can be controlled by adjusting the resistance of the fifth resistor R5 and the capacitance of the first capacitor C1. On this basis, as shown in FIG. 14, for example, the fifth resistor R5 is an adjustable resistor, such that the output of the integral compensation sub-circuit 72 can be adjusted by adjusting the resistance of the fifth resistor R5 in combination with the characteristics of different panels.

As shown in FIG. 13, the proportional compensation sub-circuit 731 includes a third amplifier A3, a seventh resistor R7, an eighth resistor R8 and a ninth resistor R9.

One terminal of the seventh resistor R7 is connected to an output terminal of the difference circuit 71, and another terminal of the seventh resistor R7 is connected to an inverting input terminal of the third amplifier A3. For example, in a case where the difference circuit 71 includes the first amplifier A1, the first resistor R1, the second resistor R2, the third resistor R3 and the fourth resistor R4, one terminal of the seventh resistor R7 is connected to the output terminal of the first amplifier A1.

One terminal of the eighth resistor R8 is connected to a non-inverting input terminal of the third amplifier A3, and another terminal of the eighth resistor R8 is grounded.

One terminal of the ninth resistor R9 is connected to an inverting input terminal of the third amplifier A3, and another terminal of the ninth resistor R9 is connected to an output terminal of the third amplifier A3.

It can be seen from the specific circuit of the proportional compensation sub-circuit 731 that the output of the proportional compensation sub-circuit 731 can be controlled by adjusting the resistance of the seventh resistor R7 and the ninth resistor R9. On this basis, as shown in FIG. 8, for example, the seventh resistor R7 is an adjustable resistor, such that the output of the proportional compensation sub-circuit 731 can be adjusted by adjusting the resistance of the seventh resistor R7 in combination with the characteristics of different panels.

As shown in FIG. 13, the differential compensation sub-circuit 732 includes a fourth amplifier A4, a tenth resistor R10, an eleventh resistor R11, a twelfth resistor R12 and a second capacitor C2.

One terminal of the second capacitor C2 is connected to an output terminal of the difference circuit 71, and another terminal of the second capacitor C2 is connected to a terminal of the tenth resistor R10. For example, in a case where the difference circuit 71 includes the first amplifier A1, the first resistor R1, the second resistor R2, the third resistor R3 and the fourth resistor R4, one terminal of the second capacitor C2 is connected to an output terminal of the first amplifier A1.

Another terminal of the tenth resistor R10 is connected to an inverting input terminal of the fourth amplifier A4.

One terminal of the eleventh resistor R11 is connected to a non-inverting input terminal of the fourth amplifier A4, and another terminal of the eleventh resistor R11 is grounded.

One terminal of the twelfth resistor R12 is connected to an inverting input terminal of the fourth amplifier A4, and another terminal of the twelfth resistor R12 is connected to an output terminal of the fourth amplifier A4.

It is seen from the specific circuit of the differential compensation sub-circuit 732 that the output of the differential compensation sub-circuit 732 can be controlled by adjusting the resistance of the tenth resistor R10 and the twelfth resistor R12 and the capacitance of the second capacitor C2. On this basis, as shown in FIG. 14, for example, the tenth resistor R10 is an adjustable resistor, such that the output of the differential compensation sub-circuit 732 can be adjusted by adjusting the resistance of the tenth resistor R10 in combination with the characteristics of different panels.

As shown in FIG. 13 and FIG. 14, the summing circuit 75 includes a fifth amplifier A5, a thirteenth resistor R13, a fourteenth resistor R14, a fifteenth resistor R15, a sixteenth resistor R16 and a seventeenth resistor R17.

One terminal of the thirteenth resistor R13 is connected to an output terminal of the proportional compensation sub-circuit 72, and another terminal of the thirteenth resistor R13 is connected to an inverting input terminal of the fifth amplifier A5. For example, in a case where the integral compensation sub-circuit 72 includes the second amplifier A2, the fifth resistor R5, the sixth resistor R6 and the first capacitor C1, one terminal of the thirteenth resistor R13 is connected to an output terminal of the second amplifier A2.

One terminal of the fourteenth resistor R14 is connected to an output terminal of the proportional compensation sub-circuit 731, and another terminal of the fourteenth resistor R14 is connected to an inverting input terminal of the fifth amplifier A5. For example, in a case where the proportional compensation sub-circuit 731 includes a third amplifier A3, a seventh resistor R7, an eighth resistor R8 and a ninth resistor R9, one terminal of the fourteenth resistor R14 is connected to an output terminal of the third amplifier A3.

One terminal of the fifteenth resistor R15 is connected to an output terminal of the differential compensation sub-circuit 732, and another terminal of the fifteenth resistor R15 is connected to an inverting input terminal of the fifth amplifier A5. For example, in a case where the differential compensation sub-circuit 732 includes a fourth amplifier A4, a tenth resistor R10, an eleventh resistor R11, a twelfth resistor R12 and a second capacitor C2, one terminal of the fifteenth resistor R15 is connected to an output terminal of the fourth amplifier A4.

One terminal of the sixteenth resistor R16 is connected to a non-inverting input terminal of the fifth amplifier A5, and another terminal of the sixteenth resistor R16 is grounded.

One terminal of the seventeenth resistor R17 is connected to an inverting input terminal of the fifth amplifier A5, and another terminal of the seventeenth resistor R17 is connected to an output terminal of the fifth amplifier A5. For example, an output terminal of the fifth amplifier A5 is connected to the common voltage output terminal $V_{COM-O}$.

Figure 15:
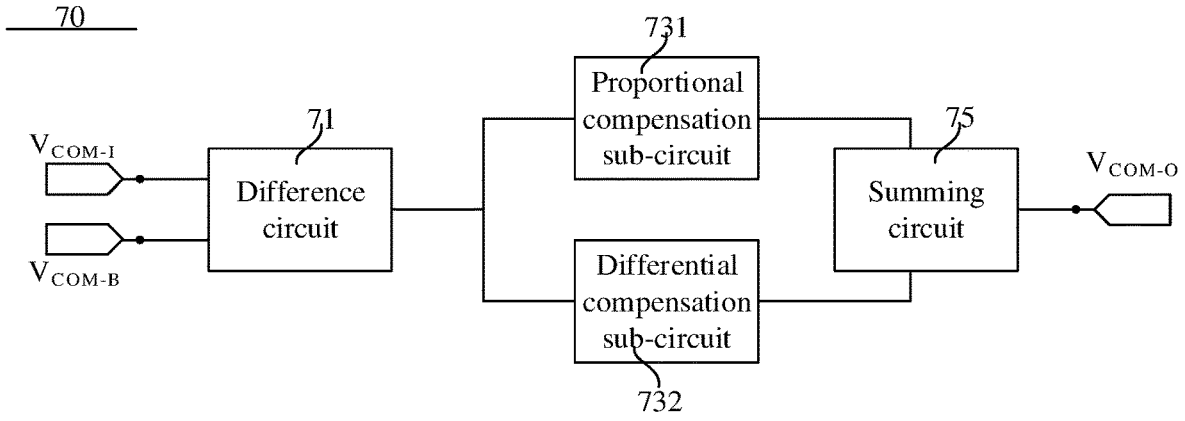
FIG. 15 is a schematic diagram of still another example of a common voltage calibration circuit according to an embodiment of the present disclosure.
Figure 16:
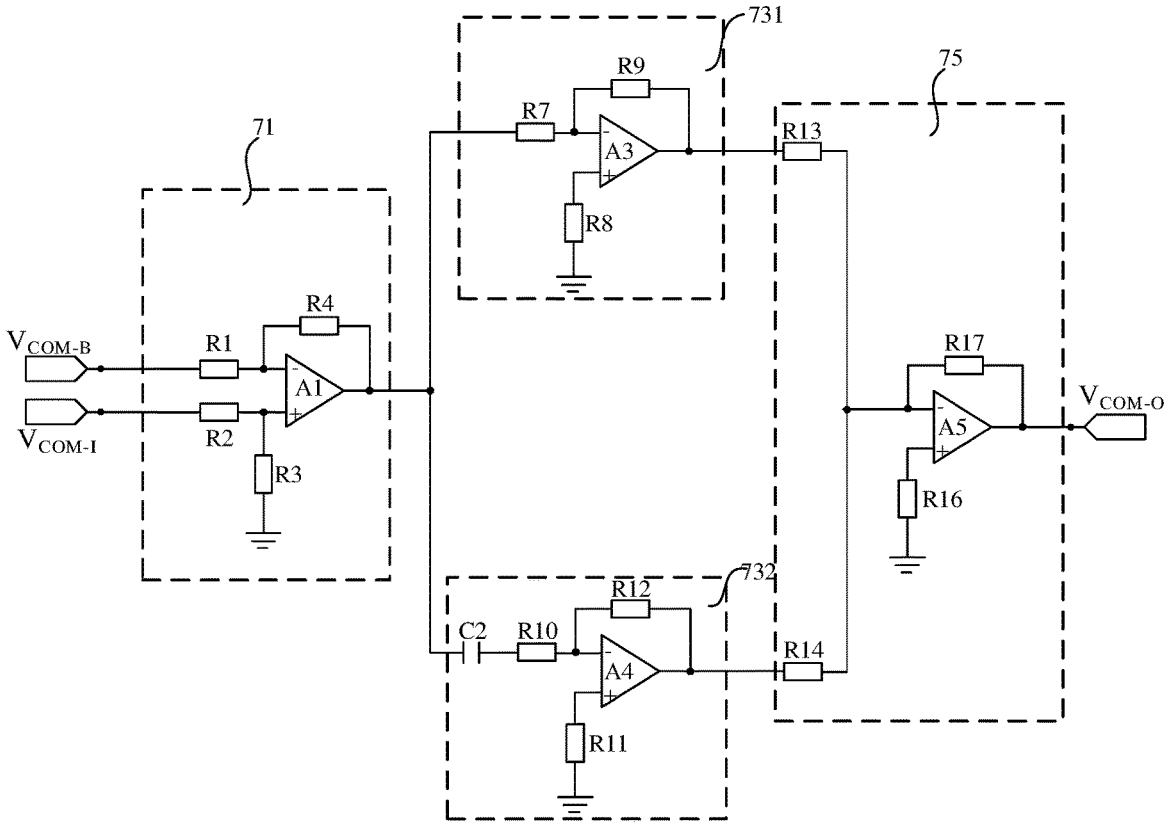
FIG. 16 is a schematic diagram showing the circuit structure of a specific implementation example of the common voltage calibration circuit shown in FIG. 15.

FIG. 16 is a schematic diagram showing the circuit structure of a specific implementation example of the common voltage calibration circuit shown in FIG. 15. For example, the common voltage calibration circuit 70 in this example is similar in structure to the common voltage calibration circuit 70 shown in FIG. 9, with the difference that the compensation circuit 73 includes a proportional compensation sub-circuit 731 and a differential compensation sub-circuit 732. As shown in FIG. 16, the common voltage calibration circuit 70 includes a difference circuit 71, a proportional compensation sub-circuit 731, a differential compensation sub-circuit 732 and a summing circuit 75.

The common voltage calibration circuit 70 provided by the example obtains the voltage difference value between the common voltage input terminal $V_{COM-I}$ and the common voltage feedback terminal $V_{COM-B}$ through the difference circuit 71, and inversely amplifies the voltage difference value output by the difference circuit 71 through the proportional compensation sub-circuit 731, achieving real-time suppression on the pull action on the common voltage during the common voltage transfer process and attenuating fluctuation of the common voltage actually input to the common electrode 16; the common voltage can be adjusted and compensated, and the change of the common voltage can be predicted through the differential compensation sub-circuit 732, thereby effectively suppressing the overshoot and improving the stability of the common voltage. On the basis of this, the output results of the proportional compensation sub-circuit 731 and the differential compensation sub-circuit 732 are superimposed and output by the summing circuit 75, such that the common voltage calibration circuit provided by the embodiments of the present disclosure can satisfy a requirements for control accuracy, response speed and stability of the common voltage, thereby effectively alleviating cross-talk and afterimage, and improving display quality of the display panel.

FIG. 16 is a schematic diagram showing the circuit structure of a specific implementation example of the common voltage calibration circuit shown in FIG. 15. As shown in FIG. 16, the difference circuit 71 includes a first amplifier A1, a first resistor R1, a second resistor R2, a third resistor R3, and a fourth resistor R4.

One terminal of the first resistor R1 is connected to the common voltage feedback terminal $V_{COM-B}$, and another terminal of the first resistor R1 is connected to an inverting input terminal of the first amplifier A1.

One terminal of the second resistor R2 is connected to the common voltage input terminal $V_{COM-I}$, and another terminal of the second resistor R2 is connected to a non-inverting input terminal of the first amplifier A1.

One terminal of the third resistor R3 is connected to a non-inverting input terminal of the first amplifier A1, and another terminal of the third resistor R3 is grounded.

One terminal of the fourth resistor R4 is connected to an inverting input terminal of the first amplifier A1, and another terminal of the fourth resistor R4 is connected to an output terminal of the first amplifier A1.

As shown in FIG. 16, the proportional compensation sub-circuit 731 includes a third amplifier A3, a seventh resistor R7, an eighth resistor R8 and a ninth resistor R9.

One terminal of the seventh resistor R7 is connected to an output terminal of the difference circuit 71, and another terminal of the seventh resistor R7 is connected to an inverting input terminal of the third amplifier A3. For example, in a case where the difference circuit 71 includes the first amplifier A1, the first resistor R1, the second resistor R2, the third resistor R3 and the fourth resistor R4, one terminal of the seventh resistor R7 is connected to the output terminal of the first amplifier A1.

One terminal of the eighth resistor R8 is connected to a non-inverting input terminal of the third amplifier A3, and another terminal of the eighth resistor R8 is grounded.

One terminal of the ninth resistor R9 is connected to an inverting input terminal of the third amplifier A3, and another terminal of the ninth resistor R9 is connected to an output terminal of the third amplifier A3.

Figure 17:
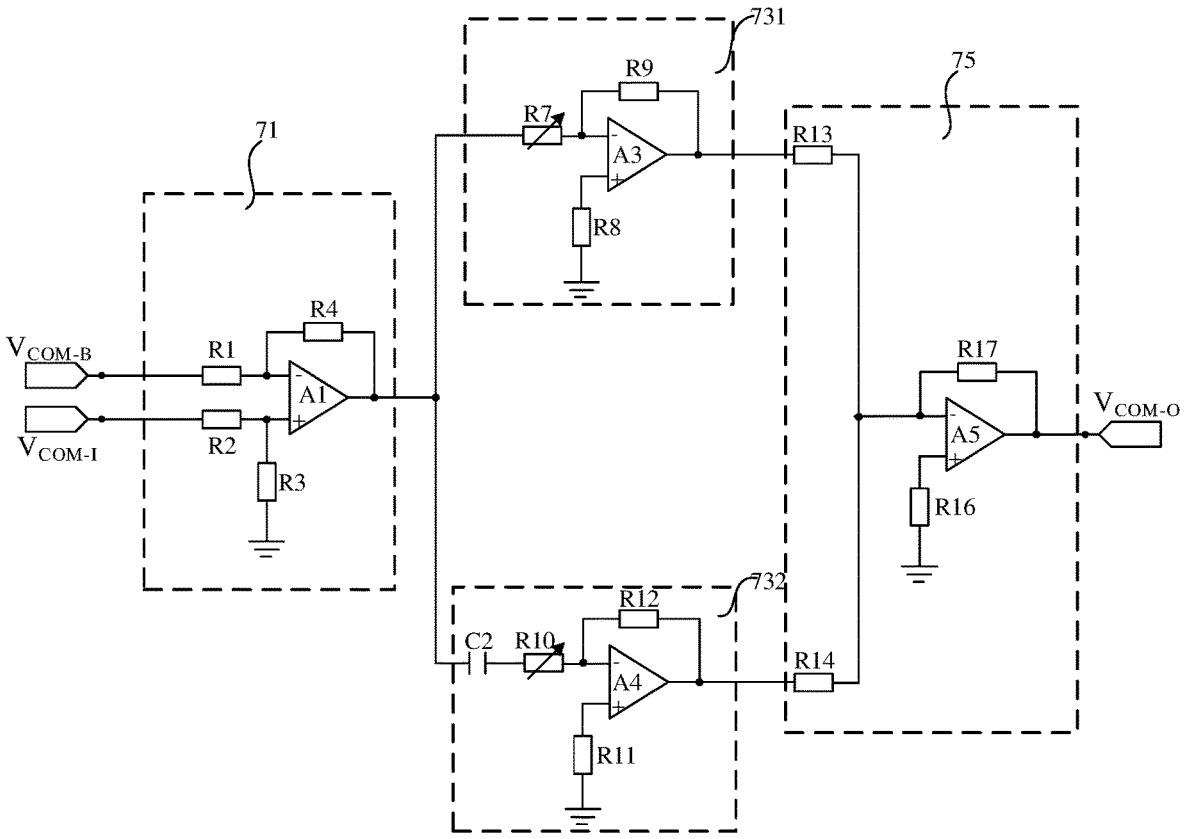
FIG. 17 is a schematic diagram showing the circuit structure of a specific implementation example of the common voltage calibration circuit shown in FIG. 15.

It can be seen from the specific circuit of the proportional compensation sub-circuit 731 that the output of the proportional compensation sub-circuit 731 can be controlled by adjusting the resistance of the seventh resistor R7 and the ninth resistor R9. On this basis, as shown in FIG. 17, for example, the seventh resistor R7 is an adjustable resistor, such that the output of the proportional compensation sub-circuit 731 can be adjusted by adjusting the resistance of the seventh resistor R7 in combination with the characteristics of different panels.

As shown in FIG. 13, the differential compensation sub-circuit 732 includes a fourth amplifier A4, a tenth resistor R10, an eleventh resistor R11, a twelfth resistor R12 and a second capacitor C2.

One terminal of the second capacitor C2 is connected to an output terminal of the difference circuit 71, and another terminal of the second capacitor C2 is connected to a terminal of the tenth resistor R10. For example, in a case where the difference circuit 71 includes the first amplifier A1, the first resistor R1, the second resistor R2, the third resistor R3 and the fourth resistor R4, one terminal of the second capacitor C2 is connected to an output terminal of the first amplifier A1.

Another terminal of the tenth resistor R10 is connected to an inverting input terminal of the fourth amplifier A4.

One terminal of the eleventh resistor R11 is connected to a non-inverting input terminal of the fourth amplifier A4, and another terminal of the eleventh resistor R11 is grounded.

One terminal of the twelfth resistor R12 is connected to an inverting input terminal of the fourth amplifier A4, and another terminal of the twelfth resistor R12 is connected to an output terminal of the fourth amplifier A4.

It can be seen from the specific circuit of the differential compensation sub-circuit 732 that the output of the differential compensation sub-circuit 732 can be controlled by adjusting the resistance of the tenth resistor R10 and the twelfth resistor R12 and the capacitance of the second capacitor C2. On this basis, as shown in FIG. 17, for example, the tenth resistor R10 is an adjustable resistor, such that the output of the differential compensation sub-circuit 732 can be adjusted by adjusting the resistance of the tenth resistor R10 in combination with the characteristics of different panels.

As shown in FIG. 16 and FIG. 17, the summing circuit 75 includes a fifth amplifier A5, a thirteenth resistor R13, a fourteenth resistor R14, a fifteenth resistor R15, a sixteenth resistor R16 and a seventeenth resistor R17.

One terminal of the thirteenth resistor R13 is connected to an output terminal of the proportional compensation sub-circuit 731, and another terminal of the thirteenth resistor R13 is connected to an inverting input terminal of the fifth amplifier A5. For example, in a case where the proportional compensation sub-circuit 731 includes a third amplifier A3, a seventh resistor R7, an eighth resistor R8 and a ninth resistor R9, one terminal of the fourteenth resistor R14 is connected to an output terminal of the third amplifier A3.

One terminal of the fourteenth resistor R14 is connected to an output terminal of the differential compensation sub-circuit 732, and another terminal of the fourteenth resistor R14 is connected to an inverting input terminal of the fifth amplifier A5. For example, in a case where the differential compensation sub-circuit 732 includes a fourth amplifier A4, a tenth resistor R10, an eleventh resistor R11, a twelfth resistor R12 and a second capacitor C2, one terminal of the fourteenth resistor R14 is connected to an output terminal of the fourth amplifier A4.

One terminal of the sixteenth resistor R16 is connected to a non-inverting input terminal of the fifth amplifier A5, and another terminal of the sixteenth resistor R16 is grounded.

One terminal of the seventeenth resistor R17 is connected to an inverting input terminal of the fifth amplifier A5, and another terminal of the seventeenth resistor R17 is connected to an output terminal of the fifth amplifier A5. For example, an output terminal of the fifth amplifier A5 is connected to the common voltage output terminal $V_{COM\text{-}O}$.

It should be noted that a free combination of the sub-circuits included in the compensation circuit 73 can be realized by controlling the selective connection among the thirteenth resistor R13, the fourteenth resistor R14 and the fifteenth resistor R15, thereby making the circuit combination diverse, for example, the circuit combination may be transformed into the circuit in anyone of the above examples. In this case, the adjustability of the compensation coefficient of each of the sub-circuits and the diversity of the combination of unit circuits also enable the compensation adjustment of the $V_{COM}$ by the common voltage calibration circuit to adapt to different types of models of device.

Based on the common voltage calibration circuit 70 provided by any one of the embodiments of the present disclosure, the third resistor R3, the sixth resistor R6, the eighth resistor R8, the eleventh resistor R11 and the sixteenth resistor R16 in each one of the circuits can reduce the zero drift of operational amplifier, thereby further improving the adjustment accuracy of the circuits to the common voltage. In addition, based on the specific circuit above-described, a complicated processing circuit chip is not required, and advantages such as low application cost, high practicability and the like can be obtained.

Because the proportional compensation sub-circuit 731 can realize real-time suppression on the pull action on the common voltage and has characteristics of fast response, the common voltage calibration circuit 70 including the proportional compensation sub-circuit 731 may be preferentially selected for the calibration for the common voltage. For example, in a case where the common voltage has been calibrated by the common voltage calibration circuit 70 including the proportional compensation sub-circuit 731 according to different types of display panels and through adjusting relevant parameters, the common voltage actually input to the common electrode 16, that is, the common voltage obtained from the common voltage feedback terminal $V_{COM\text{-}B}$, can be referred to the solid line 51 in FIG. 5, that is, the solid line 51 in Fig. 5 represents the common voltage obtained from the common voltage feedback terminal $V_{COM\text{-}B}$ with the common voltage calibration circuit 70, whereby it can be seen that the common voltage actually input to the common electrode 16 does not change much compared to the desired common voltage.

In a case where a compensation circuit 73 of a common voltage calibration circuit 70 only includes an integral compensation sub-circuit 72 and a differential compensation sub-circuit 732, relevant parameters according to different types of display panels are adjusted, and after the common voltage is calibrated by the common voltage calibration circuit 70, the common voltage actually input to the common electrode 16, that is, the common voltage obtained from the common voltage feedback terminal $V_{COM\text{-}B}$, can also achieve an effect similar to the solid line shown in FIG. 5.

At least one embodiment of the present disclosure also provides a circuit board including the common voltage calibration circuit above-described. For example, the circuit board may be used for an OLED display device, a liquid crystal display device or the like. The embodiments of the present disclosure are not limited in this aspect.

At least one embodiment of the present disclosure also provides a display device. The display device includes a display panel and a common voltage calibration circuit provided by any one of the embodiments of the present disclosure. For example, the display panel includes a common electrode. For example, the common electrode is electrically connected to a common voltage output terminal $V_{COM-O}$ of a common voltage calibration circuit. For example, a detailed description of the display device may be described in reference to FIG. 1 to FIG. 3, and details are not described herein again.

At least one embodiment of the present disclosure provides a driving method of the common voltage calibration circuit 70. For example, the driving method comprises: performing, by the difference circuit 71, a difference processing on the common voltage and the feedback common voltage and outputting a difference value signal; performing, by the compensation circuit 73, inverse amplification, integration, and/or differential adjustment on the difference value signal to compensate the common voltage; and superimposing, by the compensation circuit 73, at least two compensation signals output to obtain a common voltage which is compensated by the summing circuit 75, and outputting the common voltage through the common voltage output terminal $V_{COM-O}$.

For example, the compensation circuit 73 of the common voltage calibration circuit 70 may include a proportional compensation sub-circuit 731, and may further include an integral compensation sub-circuit 72 or a differential compensation sub-circuit 732.

In this way, the corresponding circuits can be first fabricated on a PCB, so as to selectively select any two of the proportional compensation sub-circuit 731, the integral compensation sub-circuit 72 and/or the differential compensation sub-circuit 732 to calibrate the common voltage according to the characteristics of a specific display panel. For example, if the proportional compensation sub-circuit 731 is not required to operate, the device corresponding to the proportional compensation sub-circuit 731 may not be attached to the corresponding circuit; similarly, the principles of the differential compensation sub-circuit 732 and the integral compensation sub-circuit 72 are similar.

It should be noted that, detailed description and technical effects of the driving method above-described may refer to the description of the working principle of the common voltage calibration circuit 70 in the embodiments of the present disclosure, and details are not described herein again.

The above is only the specific embodiment of the present disclosure, the scope of the present disclosure is not limited thereto, and the scope of the present disclosure should be determined by the scope of the claims.

What is claimed is:

1. A common voltage calibration circuit, comprising a difference circuit, a compensation circuit, and a summing circuit;

wherein the difference circuit is connected to a common voltage input terminal and a common voltage feedback terminal, and is configured to perform a difference processing on a common voltage provided by the common voltage input terminal and a feedback common voltage provided by the common voltage feedback terminal to output a difference value signal;

the compensation circuit is connected to the difference circuit and the summing circuit, and is configured to receive the difference value signal and compensate the common voltage based on the difference value signal; and the summing circuit is connected to the compensation circuit and a common voltage output terminal, and is configured to superimpose at least two compensation signals outputted by the compensation circuit and to output the superimposed at least two compensation signals through the common voltage output terminal;

wherein the compensation circuit comprises at least two of a proportional compensation sub-circuit, an integral compensation sub-circuit, and a differential compensation sub-circuit;

the proportional compensation sub-circuit is connected to the differences circuit and the summing circuit, and configured to inversely amplify the difference value signal outputted by the different circuit;

the integral compensation sub-circuit is connected to the difference circuit and the summing circuit, and configured to perform an integration processing on the difference value signal outputted by the difference circuit to control accuracy of the common voltage; and the differential compensation sub-circuit is connected to the difference circuit and the summing circuit, and configured to generate an adjustment signal according to the difference value signal outputted by the difference circuit to adjust the common voltage.

2. A common voltage calibration circuit according to claim 1, wherein the difference circuit comprises a first amplifier, a first resistor, a second resistor, a third resistor, and a fourth resistor;

one terminal of the first resistor is connected to the common voltage feedback terminal, another terminal of the first resistor is connected to an inverting input terminal of the first amplifier;

one terminal of the second resistor is connected to the common voltage input terminal, another terminal of the second resistor is connected to a non-inverting input terminal of the first amplifier, one terminal of the third resistor is connected to the non-inverting input terminal of the first amplifier, another terminal of the third resistor is grounded; and one terminal of the fourth resistor is connected to the inverting input terminal of the first amplifier, another terminal of the fourth resistor is connected to an output terminal of the first amplifier.

3. The common voltage calibration circuit according to claim 1, wherein the integral compensation sub-circuit comprises a second amplifier, a fifth resistor, a sixth resistor, and a first capacitor;

one terminal of the fifth is connected to an to an output terminal of the difference circuit, another terminal of the fifth resistor is connected to an inverting input terminal of the second amplifier;

one terminal of the sixth resistors connected to a non-inverting input terminal of the second amplifier, another terminal of the sixth resistor is grounded; and one terminal of the first capacitor is connected to the inverting input terminal of the second amplifier, another terminal of the first capacitor is connected to an output terminal of the second amplifier.

4. The common voltage calibration circuit according to claim 3, the fifth resistor is an adjustable resistor.

5. The common voltage calibration circuit according to claim 1, wherein the proportional compensation sub-circuit comprises a third amplifier, a seventh resistor, and eighth resistor, and a ninth resistor;

one terminal of the seventh resistor is connected to an output terminal of the difference circuit, another terminal of the seventh resistor is connected to an inverting input terminal of the third amplifier;

one terminal of the eighth resistor is connected to a non-inverting input terminal of the third amplifier, another terminal of the eighth resistor is grounded; and one terminal of the ninth resistor is connected to the inverting input terminal of the third amplifier, another terminal of the ninth resistor is connected to an output terminal of the third amplifier.

6. The common voltage calibration circuit according to claim 5, wherein the seventh resistor is a adjustable resistor.

7. The common voltage calibration circuit according to claim 1, wherein the differential compensation sub-circuit comprises a fourth amplifier, a tenth resistor, an eleventh resistor, a twelfth resistor, and second capacitor;

one terminal of the second capacitor is connected to an output terminal of the difference circuit, another terminal of the second capacitor is connected to a terminal of the tenth resistor;

another terminal of the tenth resistor is connected to an inverting input terminal of the fourth amplifier;

one terminal of the eleventh resistor is connected t non-inverting input terminal of the fourth amplifier, another terminal of the eleventh resistor is grounded; and one terminal of the twelfth resistor is connected to the inverting input terminal of the fourth amplifier, another terminal of the twelfth resistor is connected to an output terminal of the fourth amplifier.

8. The common voltage calibration circuit according to claim 7, wherein tenth resistor is an adjustable resistor.

9. The common voltage calibration circuit according to claim 1, wherein, in a case where the compensation circuit comprises the proportional compensation sub-circuit and the differential compensation sub-circuit, the summing circuit comprises a fifth amplifier, a thirteenth resistor, a fourteenth resistor, a sixteenth resistor, a seventeenth resistor;

one terminal of the thirteenth resistor is connected to an output terminal of the proportional compensation sub-circuit, another terminal of the thirteenth resistor is connected to an inverting input terminal of the fifth amplifier;

one terminal of the fourteenth resistor is connected to an output terminal of the differential compensation sub-circuit, another terminal of the fourteenth resistor is connected to the inverting input terminal of the fifth amplifier;

one terminal of the sixteenth resistor is connected to a non-inverting input terminal of the fifth amplifier, another terminal of the sixteenth resistor is grounded;

one terminal of the seventeenth resistor is connected to the inverting input terminal of fifth amplifier, another terminal of the seventeenth resistor is connected to an output terminal of the fifth amplifier; and an output terminal of the fifth amplifier is connected to the common voltage output terminal.

10. The common voltage calibration circuit according to claim 1, wherein, in a case where the compensation circuit comprises the proportional compensation sub-circuit and the integral compensation sub-circuit, the summing circuit comprises an fifth amplifier, a thirteenth resistor, a fourteenth resistor, a sixteenth resistor, and a seventeenth resistor;

one terminal of the thirteenth resistor is connected to an output terminal of the proportional compensation sub-circuit, another terminal of the thirteenth resistor is connected to an inverting input terminal of the fifth amplifier;

one terminal of the fourteenth resistor is connected to an output terminal of the integral compensation sub-circuit, another terminal of the fourteenth resistor is connected to the inverting input terminal of the fifth amplifier;

one terminal of the sixteenth resistor is connected to a non-inverting input terminal of the fifth amplifier, another terminal of the sixteenth resistor is grounded;

one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

11. The common voltage calibration circuit according to claim 1, wherein, in a case where the compensation circuit comprises the proportional compensation sub-circuit and the integral compensation sub-circuit, the summing circuit comprises a fifth amplifier, a thirteenth resistor, a fourteenth resistor, a sixteenth resistor, and a seventeenth resistor;

one terminal of the thirteenth resistor is connected to an output terminal of the integral compensation sub-circuit, another terminal of the thirteenth resistor is connected to an inverting input terminal of the fifth amplifier;

one terminal of the fourteenth resistor is connected to an output terminal of the differential compensation sub-circuit, another terminal of the fourteenth resistor is connected to inverting input terminal of the fifth amplifier;

one terminal of the sixteenth resistor is connected to non-inverting input terminal of the fifth amplifier, another terminal of the sixteenth resistor is grounded;

one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

12. The common voltage calibration circuit according to claim 1, wherein, in a case where the compensation circuit comprises the proportional compensation sub-circuit, the integral compensation sub-circuit andthe differential compensation sub-circuit, the summing circuit comprises a fifth amplifier, a thirteenth resistor, a fourteenth resistor, a fifteenth resistor, a sixteenth resistor, and a seventeenth resistor;

one terminal of the thirteenth resistor is connected to an output terminal of the integral compensation sub-circuit, another terminal of the thirteenth resistor is connected to an inverting input terminal of the fifth amplifier;

one terminal of the fourteenth resistor is connected to an output terminal of the proportional compensation sub-circuit, another terminal of the fourteenth resistor is connected to the inverting input terminal of the fifth amplifier;

one terminal of the fifteenth resistor is connected to an output terminal of the differential compensation sub-circuit, another terminal of the fifteenth resistor is connected to the inverting input terminal of the fifth amplifier;

one terminal of the sixteenth resistor is connected to a non-inverting input terminal of the fifth amplifier, another terminal of the sixteenth resistor is grounded;

one terminal of the seventeenth resistor is connected to the inverting input terminal of the fifth amplifier, another terminal of the seventeenth resistor is connected to an output terminal of the fifth amplifier; and an output terminal of the fifth amplifier is connected to the common voltage output terminal.

13. A circuit board, comprising the common voltage calibration circuit according to claim 1.

14. A display device, comprising a display panel and the common voltage calibration circuit according to claim 1, wherein the display panel comprises a common electrode electrically connected to the common voltage output terminal of the common voltage calibration circuit.

15. A display method of the common voltage calibration circuit according to claim 1, comprising:

performing, by the differences circuit, a difference processing on the common voltage and the feedback common voltage and outputting the difference value signal;

performing, by the compensation circuit, inverse amplification, integration, and/or differential adjustment on the difference value signal to compensate the common voltage; and superimposing, by the summing circuit, the at least two compensation signals outputted by the compensation circuit to obtain a common voltage which is compensated, and outputting the compensated common voltage through the common voltage output terminal.

* * * * *